US010060696B2

(12) United States Patent
Houle

(10) Patent No.: US 10,060,696 B2
(45) **Date of Patent: *Aug. 28, 2018**

(54) STRING BUMPER FOR ARROW-PROPELLING APPARATUS

(71) Applicant: PLACEMENTS GASTON HOULE INC., Wickham (CA)

(72) Inventor: Gaston Houle, Wickham (CA)

(73) Assignee: PLACEMENTS GASTON HOULE INC., Wickham (QC) (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/784,319

(22) Filed: Oct. 16, 2017

(65) Prior Publication Data

US 2018/0051957 A1 Feb. 22, 2018

Related U.S. Application Data

(63) Continuation-in-part of application No. 15/208,267, filed on Jul. 12, 2016, now Pat. No. 9,835,402.

(51) Int. Cl.

| | |
|---|---|
| ***F41B 5/20*** | (2006.01) |
| ***F41B 5/10*** | (2006.01) |
| ***F41B 5/12*** | (2006.01) |
| ***F41B 5/14*** | (2006.01) |

(52) U.S. Cl.

CPC ..... *F41B 5/1407* (2013.01); *F41B 5/12* (2013.01); *F41B 5/1426* (2013.01)

(58) Field of Classification Search

CPC ..... B60R 19/30; F41B 5/10; F41B 5/1426; F41B 5/12

See application file for complete search history.

(56) References Cited

U.S. PATENT DOCUMENTS 2,189,048 A 2/1940 Underhill
3,059,629 A 10/1962 Stinson
(Continued)

FOREIGN PATENT DOCUMENTS

CA 162740 3/2017

OTHER PUBLICATIONS

Limbsaver String Decelerator Mod 3754, by Walnut Creek Archery, in Limbsaver String Decelerator Mod 3754; Jul. 7, 2016, Upland Indiana (USA).

*Primary Examiner* — John Ricci
(74) *Attorney, Agent, or Firm* — Mathieu Audet

(57) ABSTRACT

A bumper for limiting a string displacement on a projectile accelerating apparatus is described for absorbing vibrations thereof, the bumper comprising an hollowed body including an opening portion at a first end of the body, an expansion portion inside the hollowed body and adjacent to the opening portion, a damper portion adjacent to the expansion portion inside the hollowed body, the damper portion including a volume of air that is compressible when the opening portion is closed, and a string-contacting portion disposed on an exterior surface of a second end of the body, the distal wall and the string-contacting portion being moveable toward the opening portion to compress the volume of air in the damper portion in consequence of a string contact on the string-contacting portion. A projectile accelerating apparatus including same and a method of using same are also presented.

20 Claims, 26 Drawing Sheets

(56) References Cited

U.S. PATENT DOCUMENTS

| | | | | |
|---|---|---|---|---|
| 3,197,189 | A * | 7/1965 | Pemper | B65G 69/001 114/219 |
| 3,199,819 | A | 8/1965 | Widmark | |
| 3,612,029 | A | 10/1971 | Carroll | |
| 4,061,125 | A | 12/1977 | Trotter | |
| 4,628,892 | A | 12/1986 | Windedahl | |
| 5,772,541 | A | 6/1998 | Buiatti | |
| 6,761,158 | B2 | 7/2004 | Wright | |
| D593,181 | S | 5/2009 | Barnard | |
| 7,703,449 | B2 | 4/2010 | Wright | |
| 7,721,724 | B2 | 5/2010 | Goade | |
| 7,954,481 | B2 | 6/2011 | Barnard | |
| 8,011,356 | B2 | 9/2011 | Gordon | |
| 8,033,277 | B2 | 10/2011 | Gordon | |
| 8,056,548 | B1 | 11/2011 | Larson | |
| 8,272,374 | B2 | 9/2012 | Cooper | |
| 8,365,713 | B2 | 2/2013 | Grace, Jr. | |
| D679,357 | S | 4/2013 | Wright | |
| 8,408,195 | B2 | 4/2013 | McPherson | |
| 8,453,636 | B2 | 6/2013 | Gordon | |
| 8,567,381 | B2 | 10/2013 | Saunders | |
| 8,833,356 | B2 | 9/2014 | Khoshnood | |
| 8,978,636 | B2 | 3/2015 | Bednard | |
| D774,155 | S | 12/2016 | Houle | |
| 9,835,402 | B1 * | 12/2017 | Houle | F41B 5/1426 |
| 2006/0278207 | A1 | 12/2006 | Goade | |
| 2008/0236559 | A1 | 10/2008 | Barnard | |
| 2008/0264400 | A1 | 10/2008 | Wright | |
| 2009/0032005 | A1 | 2/2009 | Wright | |
| 2009/0071457 | A1 | 3/2009 | Gordon | |
| 2009/0071458 | A1 | 3/2009 | Gordon | |
| 2009/0133683 | A1 | 5/2009 | Wright | |
| 2010/0108050 | A1 | 5/2010 | Cooper | |
| 2010/0224178 | A1 | 9/2010 | McPherson | |
| 2010/0319669 | A1 | 12/2010 | Grace, Jr. | |
| 2011/0214656 | A1 | 9/2011 | Saunders | |
| 2011/0303204 | A1 | 12/2011 | Gordon | |
| 2012/0125310 | A1 | 5/2012 | Khoshnood | |
| 2013/0174825 | A1 | 7/2013 | Bednar | |

* cited by examiner

STRING BUMPER FOR ARROW-PROPELLING APPARATUS

CROSS-REFERENCE

The present U.S. patent application claims priority from and is a Continuation-In-Part from U.S. patent application Ser. No. 15/208,267, filed Jul. 12, 2016, entitled STRING BUMPER FOR ARROW-PROPELLING DEVICE. This document is enclosed herein by reference in its entirety.

BACKGROUND OF THE INVENTION

1. Field of the Invention

This invention generally relates to arrow-propelling device improvements. The present invention more specifically relates to a string bumper used in conjunction with a bow, or a crossbow, for stopping a string thereof.

2. Description of the Related Art

Bows and crossbows are known since a long time as, originally, war tools and, later, an alternative to guns for hunting and recreation shooting. Bows and crossbows are designed to pretense a string thereof and install an arrow in a position ready to shoot. The crossbow configuration locates a stirrup at a longitudinal distal end thereof, where the arrow is propelled by the string. The crossbow is generally heading down resting on its stirrup in contact with the ground to receive a foot therein to firmly maintain the distal end of the crossbow to the ground in opposition to the force required to proximally pull the string, generally by hand power or with a mechanism facilitating the cocking, and lock the string in a position adapted to longitudinally propel the arrow when the tension in the limbs is released.

The cocking mechanism generally uses a pulley system providing the user a mechanical advantage, where the amount of input effort is multiplied to exercise greater forces on the string. The pulley system is generally embodied with a plurality of pulleys and a rope. The user can thus manually cock a string with significant tension therein that would otherwise be difficult or impossible to cock manually without a tool. Put differently, the pulley system divides the strength required to cock the string of the crossbow.

Tension from tensed limbs of the bow or the crossbow is selectively released to propel an arrow with the string. The movement of the released string accelerates to propel the arrow and decelerates when reaching the end of the string's travel. The movement of the string takes time to stop and causes vibrations that are also a source of noises. The movement of the string reaching the end of its travel can decelerate by itself when the limbs are reaching their relaxed state but to the cost of increased noise. Conversely, string bumper(s) can be added to the bow and the crossbow to purposively limit and stop the travel of the sting at a predetermined position. This string stopper hence reduces the travel of the string and the duration when the string can vibrate and create noises.

String bumpers found in the art have a limited effect for reducing the vibrations. This limited effect might result from the string bumper material, the bumper design, their position and rigidity of the assembly.

Direct contact between the string and the string bumper can generate undesirable noise detrimental to successful hunting and annoying to the shooter's ears.

Configuration of prior art string bumpers allows limited adjustment and are designed to limit the travel of the string more than damping vibrations caused by the string.

It is therefore desirable to provide an improved string bumper mechanism over the existing art that is more efficiently stopping the movement of the string.

It is desirable to provide an improved string bumper mechanism over the existing art that is more efficiently reducing the vibrations caused by the movement of the string.

It is therefore desirable to provide an improved string bumper mechanism over the existing art that is more efficiently reducing the vibrations caused by the contact of the string on the bumper.

It is also desirable to provide an improved string bumper mechanism over the existing art that provides additional vibration damping capability.

It is desirable to provide a string bumper mechanism that is an efficient shock damper.

It is desirable to provide a string bumper mechanism that is adapted to be retrofitted on existing bows and crossbows.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention is generally described as a string bumper apparatus adapted to limit a movement of a string of a bow or a crossbow at the same time as reducing the vibrations of the string and other improvements thereof.

The invention is generally described as a projectile accelerating device equipped with a string bumper apparatus adapted to limit a movement of a string of a bow or a crossbow at the same time as reducing the vibrations of the string and other improvements thereof.

Aspects of our work provide a string bumper apparatus including an internal damping chamber.

Aspects of our work provide a string bumper apparatus including an internal damping chamber filled with air.

Aspects of our work provide a string bumper apparatus including an internal damping chamber filled with air in communication with the environment through at least one opening thereof.

Aspects of our work provide a string bumper apparatus including an internal damping air chamber larger than the bumper portion connector.

Aspects of our work provide a string bumper apparatus including an internal damping air chamber larger than a complete spherical volume of the bumper portion connector's radius.

Aspects of our work provide a string bumper apparatus including an internal damping chamber configured to receive therein a damper plug adjusting the dampening effect of the string bumper apparatus.

Aspects of our work provide a string bumper apparatus including a flat string-contacting portion.

Aspects of our work provide a string bumper apparatus including a plurality of flat string contacting portions.

Aspects of our work provide a string bumper apparatus comprising a bumper portion including a pair of flat string contacting portions generally orthogonally disposed form one another.

Aspects of our work provide a string bumper apparatus comprising a bumper portion including a pair of flat string contacting portions positioned between protruding elements.

Aspects of our work provide a string bumper apparatus comprising dampening elements.

Aspects of our work provide a string bumper apparatus comprising dampening elements including cantilever portions.

Aspects of our work provide a string bumper apparatus comprising dampening elements including a pair of opposed cantilevered portions.

Aspects of our work provide a string bumper apparatus comprising dampening elements including cantilevered portions including suspended masses.

Aspects of our work provide a string bumper kit including a bumper portion and a bumper support sized and designed to create, when assembled, an empty volume inside the bumper portion.

Aspects of our work provide a string bumper apparatus including a bumper support adapted to be inserted inside a bumper portion.

Aspects of our work provide a string bumper apparatus including a bumper support adapted to be inserted inside a bumper portion with an interference fit preventing direct communication between interior of the bumper portion and the environment. Aspects of our work provide a bumper for limiting a string displacement on a projectile accelerating apparatus and absorbing vibrations thereof, the projectile accelerating device comprising a pair of limbs operatively connected with the string to propel a projectile, the bumper comprising a hollowed body including an opening portion at a first end of the body, the opening portion including a first diameter opening inside the body; an expansion portion inside the hollowed body and adjacent to the opening portion, the expansion portion widening the first diameter opening inside the hollowed body; a damper portion adjacent to the expansion portion inside the hollowed body, the damper portion extending to a distal wall thereof, the damper portion including a compressible cavity containing volume of gas therein; an opening between the cavity and the environment for allowing communication between the cavity and the environment; and a string-contacting portion disposed on an exterior surface of a second end of the body, opposed to the distal wall and adjacent to the damper portion, the damper portion being adapted to compress the volume of gas in the damper portion in consequence of a string contact on the string-contacting portion, when the bumper is secured to the projectile accelerating apparatus in an operative position.

Aspects of our work provide a projectile accelerating device comprising a body; and a bumper secured to the body for limiting a string displacement on the projectile accelerating apparatus and absorbing vibrations thereof, the bumper comprising: a hollowed body including an opening portion at a first end of the body, the opening portion including a first diameter opening inside the body; an expansion portion inside the hollowed body and adjacent to the opening portion, the expansion portion widening the first diameter opening inside the hollowed body; a damper portion adjacent to the expansion portion inside the hollowed body, the damper portion extending to a distal wall thereof, the damper portion including a cavity containing a volume of gas that is compressible when the opening portion is blocked; an opening between the cavity and the environment for allowing communication between the cavity and the environment; and a string-contacting portion disposed on an exterior surface of a second end of the body, opposed to the distal wall and adjacent to the damper portion, the damper portion being adapted to compress the volume of gas in the damper portion in consequence of a string contact on the string-contacting portion.

Aspects of our work provide a string bumper for a string-equipped projectile accelerating apparatus, the string bumper comprising a body including a compressible cavity therein for containing a gas; the body including a string contacting portion for contacting a string when the string-equipped projectile accelerating apparatus is propelling a projectile and absorb vibrations, the cavity including an opening to communicate with the environment and allow gas exchange with the environment.

Each of the embodiments of the present invention has at least one of the above-mentioned objects and/or aspects, but does not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Our work is now described with reference to the figures. In the following description, for purposes of explanations, numerous specific details are set forth in order to provide a thorough understanding of the present invention by way of embodiment(s). It may be evident, however, that the present invention may be practiced without these specific details.

Figure 1:
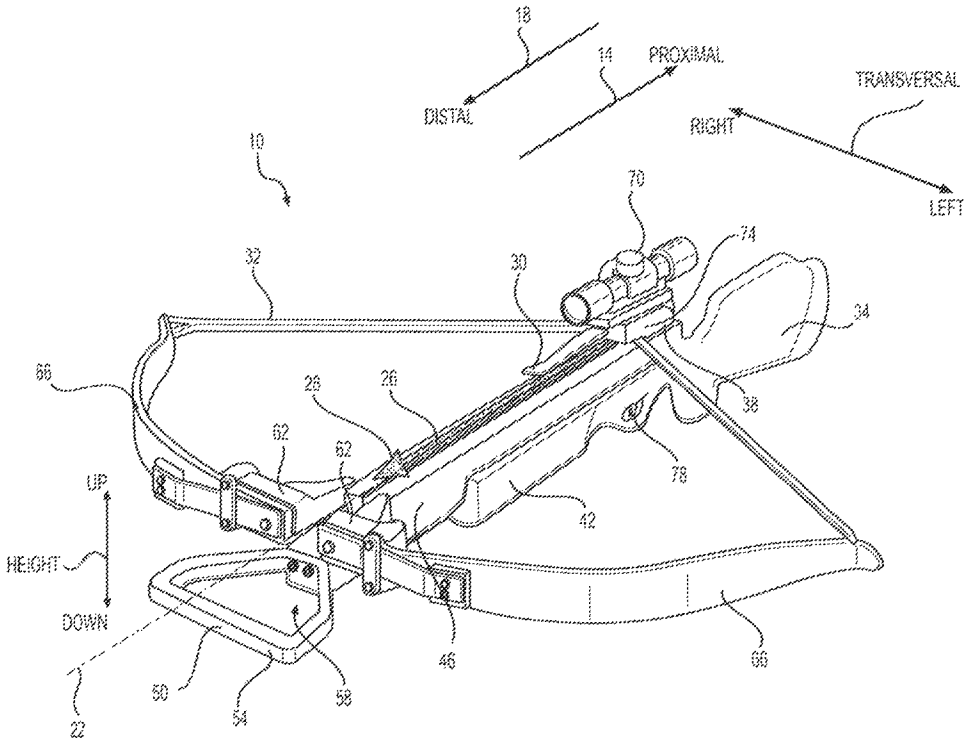
FIG. 1 is a perspective view of an illustration of a prior art crossbow.

Prior art string bumper apparatuses are going to be first discussed to facilitate the explanation of embodiments of the invention. In so doing, a projectile accelerating device, embodied as a crossbow 10 is illustrated in FIG. 1, the crossbow 10 includes a side proximal 14 to a user and a side distal 18 to the user in reference to the crossbow 10 held horizontally by a user in a shooting position. The crossbow 10 includes a longitudinal axis 22 along which an arrow 26 and its broadhead 28, when properly installed on the crossbow 10 in its flight groove and optionally held by an arrow retention spring 30, is properly located to be propelled by a string 32. The crossbow 10 further comprises a stock 34, a sight bridge 38, a foregrip 42 and a barrel 46. On its distal 18 end, the crossbow 10 includes a stirrup 50 disposed thereon. The stirrup 50 includes a frame 54 and a foot-receiving portion 58 thereof. The stirrup 50 is configured to help the user of the crossbow to cock the string 32. Generally, the distal 18 end of the crossbow 10 is contacting the ground, the user puts a foot inside the stirrup 50 and holds the stirrup 50 on the ground with a foot pressure against the tensing string 32. As illustrated, the stirrup 50 is fastened to the distal end 18 of the barrel 46 next to the riser 62 to which are connected a pair of limbs 66 on respective transversal side thereof. The pair of limbs 66 is adapted to be flexed to accumulate energy that is selectively released to propel the arrow 26. The crossbow 10 is further equipped with an optional sight 70 and a latch 74 holds the tensed string 32 that can be selectively released to let go the string 32 and propel the arrow 26 upon actuation of the trigger 78 by the user. The string 32 moves back rapidly toward the distal side 18 of the crossbow 10 and the limbs 66 return progressively to a relaxed position after having propelled the arrow 26. Propulsion of the arrow 26 generates significant vibrations when the limbs 66 are rapidly getting back to their relaxed position.

Figure 2:
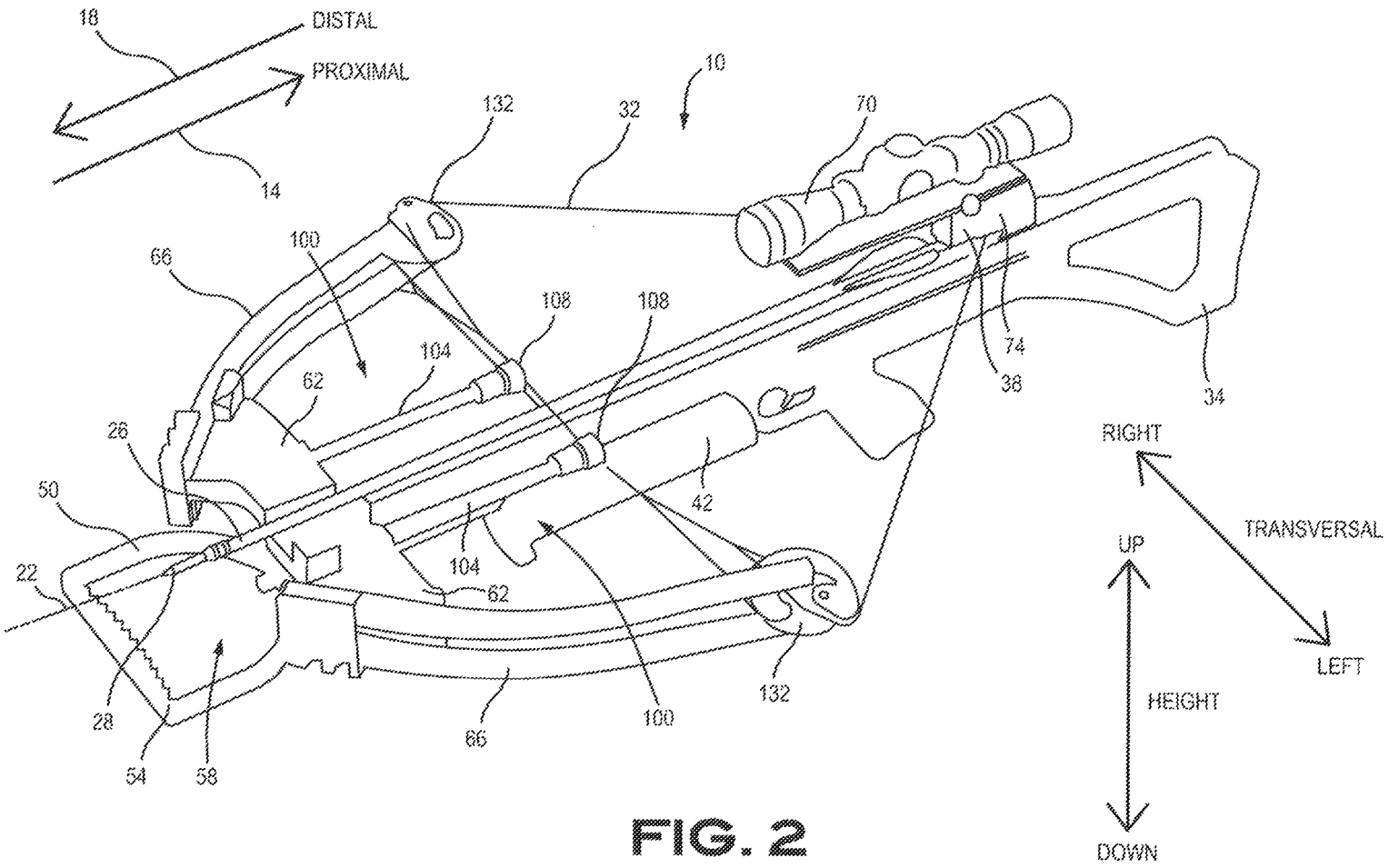
FIG. 2 PRIOR ART
FIG. 2 is a perspective view of an illustration of a prior art string stopper on a crossbow.

Turning now to FIG. 2 illustrating a typical crossbow 10 equipped with a string bumper apparatus 100 including a bumper support 104 and a bumper portion 108. The bumper support 104 is adapted to locate and support the bumper portion 108 in a position aligned with the displacement of the string 32. The bumper portion 108 is generally located about the location of the string 32, a little further than the relaxed position of the string 32, to stop the displacement of the string 32 when propelling the arrow 26.

Figure 3:
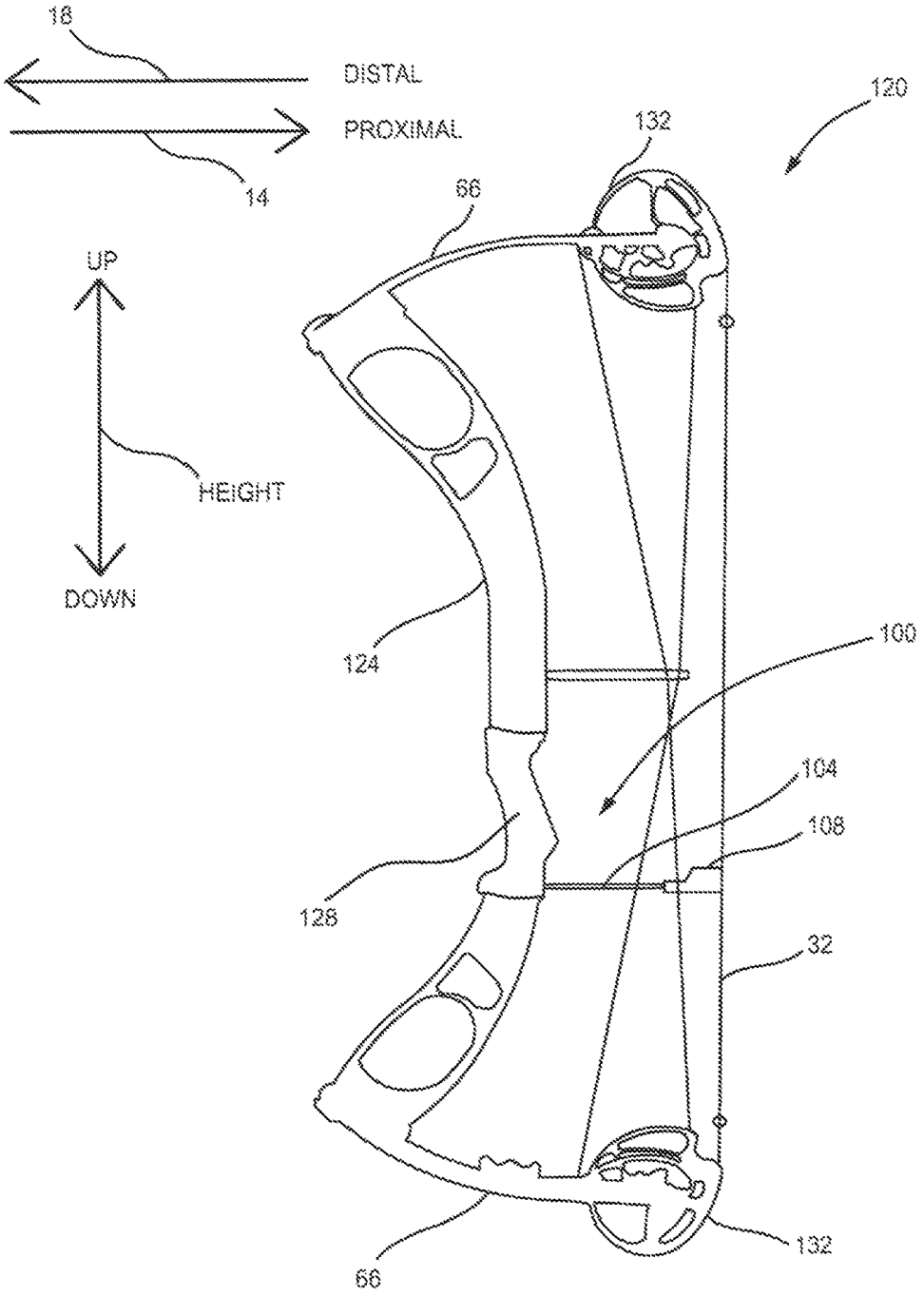
FIG. 3 PRIOR ART
FIG. 3 is a side elevation view of an illustration of a prior art string stopper on a bow.

A string bumper apparatus 100 can also be assembled to another type of projectile accelerating device, like a bow 120 as illustrated in FIG. 3. The bow 120 includes a body 124 to which are vertically assembled a pair of limbs 66 adapted to be tensed when a user is pulling the string 32. The bow 120 is held via a grip 128 disposed on the body 124 by a user for operation. The illustrated bow 120 uses optional pulleys 132 having an eccentric shape to facilitate tensing the limbs 66 and could alternatively be manufactured without pulleys 132. The bow 120 is optionally equipped with a string bumper apparatus 100 including a bumper support 104 and a bumper portion 108. The bumper support 104 is adapted to locate and support the bumper portion 108 in a position longitudinally aligned with the displacement of the string 32. The bumper portion 108 is generally located next to the location of the string 32 in its relaxed position to stop the displacement of the string 32 when propelling the arrow 26. Rubber material is generally used to manufacture the bumper portion 108 because of the material's ability to absorb shocks. The bumper portion 108 is molded in rubber forming at the same time the interior of the bumper portion 108 to mate with the associated bumper portion connector 144 that is going to be discussed below in the description. The specification below is going to details only string bumper apparatuses 100 applied to crossbows 10 without disclaimer to facilitate the reading of the text. Any detail explained in relation with a crossbow 10 encompasses its application to a bow 120 and remain within the scope of the present invention.

Figure 4:
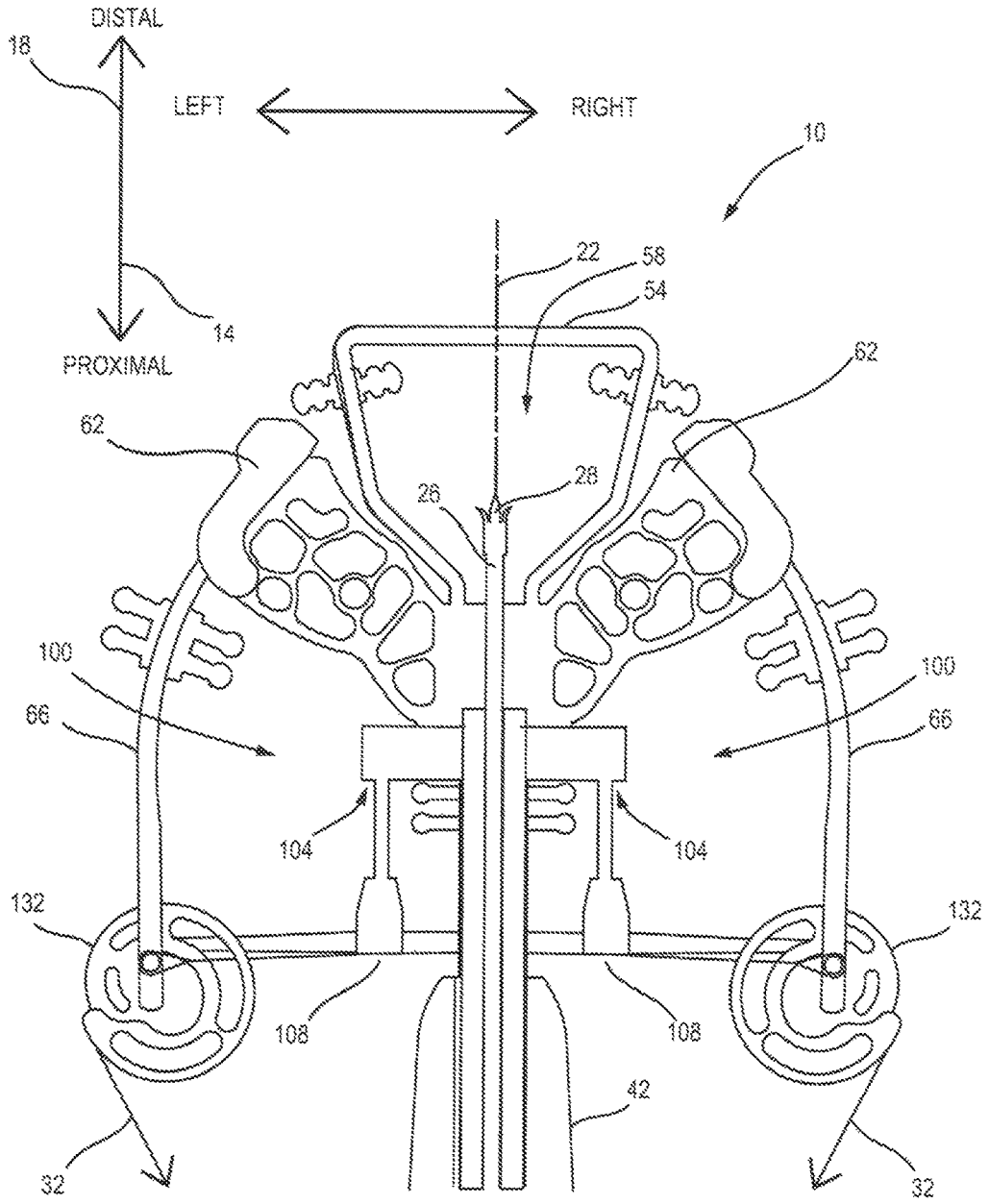
FIG. 4 PRIOR ART
FIG. 4 is a top plan view of an illustration of a prior art string stopper on a crossbow.

A string bumper apparatus 100 can include a plurality of bumper supports 104 and bumper portions 108 that can be assembled on a crossbow 10. Two string bumper apparatuses 100 are depicted in FIG. 4 in association with a crossbow 10. The two string bumper apparatuses 100 are exemplified secured, at equal distance, on both sides of the longitudinal axis 22 of the crossbow 10. The pair of string bumper apparatuses 100 is providing increased string stopping capability. A single string bumper apparatus 100 could alternatively be used. The string bumper apparatus 100 is illustrated with more details in FIG. 5. The bumper supports 104 includes a first support member 112 adapted to be secured to the crossbow 10 with fasteners 118 and can optionally allow for adjustment of the bumper portion 108 location to match the desired point of contact with the string 32. The bumper supports 104 further includes a second support member 116 adapted to be secured to the first support member 112 on a lateral side thereof and to the bumper portion 108 on a proximal side thereof and can optionally allow for additional adjustment of the bumper portion 108 location. The bumper support 104 is adapted to locate and support the bumper portion 108 in a position aligned with the longitudinal displacement of the string 32. The bumper portion 108 is generally located next to the location of the string 32 in its relaxed position to stop the displacement of the string 32 when propelling the arrow 26.

Figure 5:
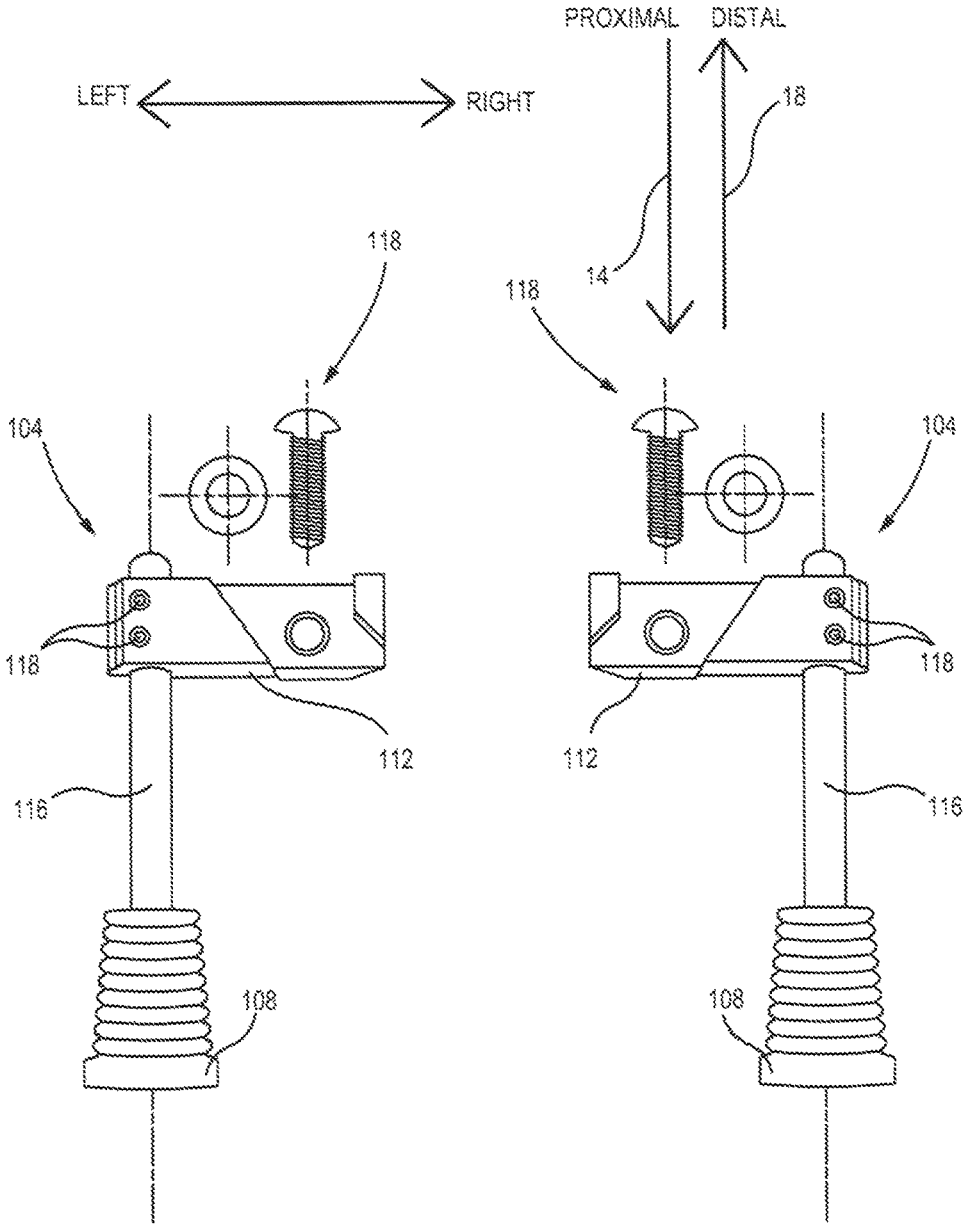
FIG. 5 PRIOR ART
FIG. 5 is a top plan view of an illustration of a prior art string stopper system.
Figure 6:
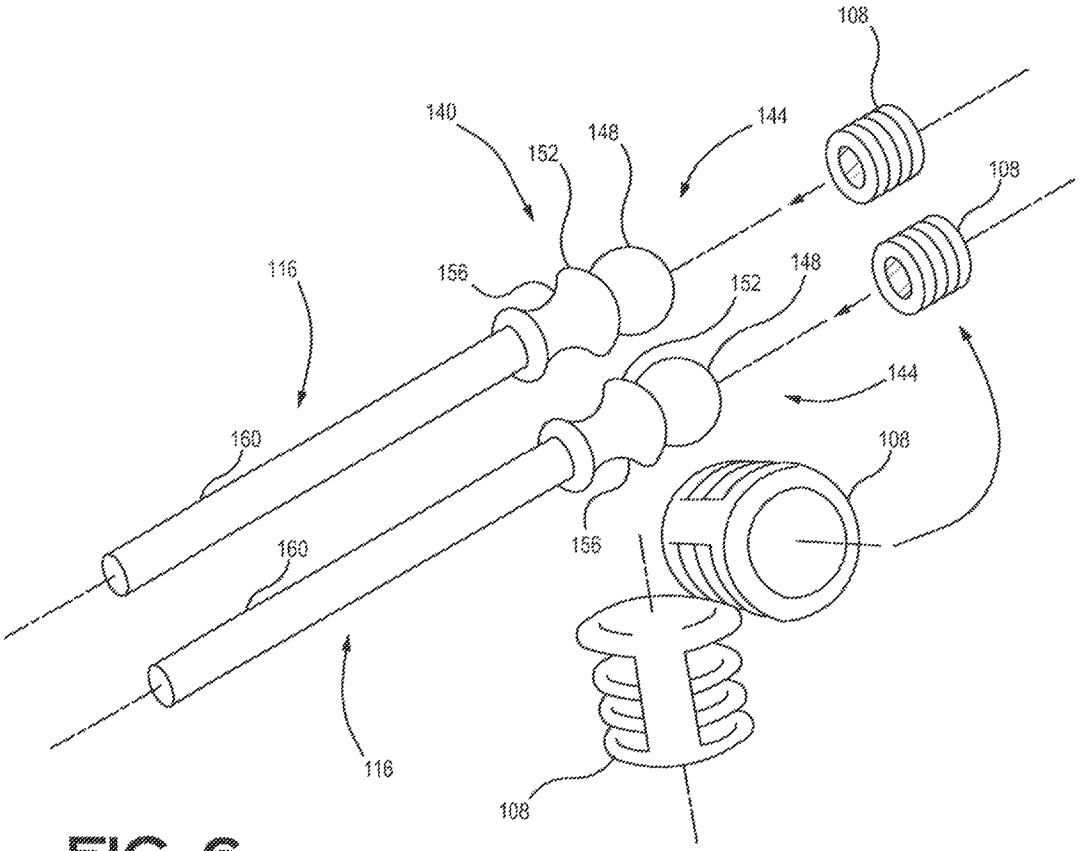
FIG. 6 PRIOR ART
FIG. 6 is a perspective view of an illustration of a prior art string stopper system.
Figure 7:
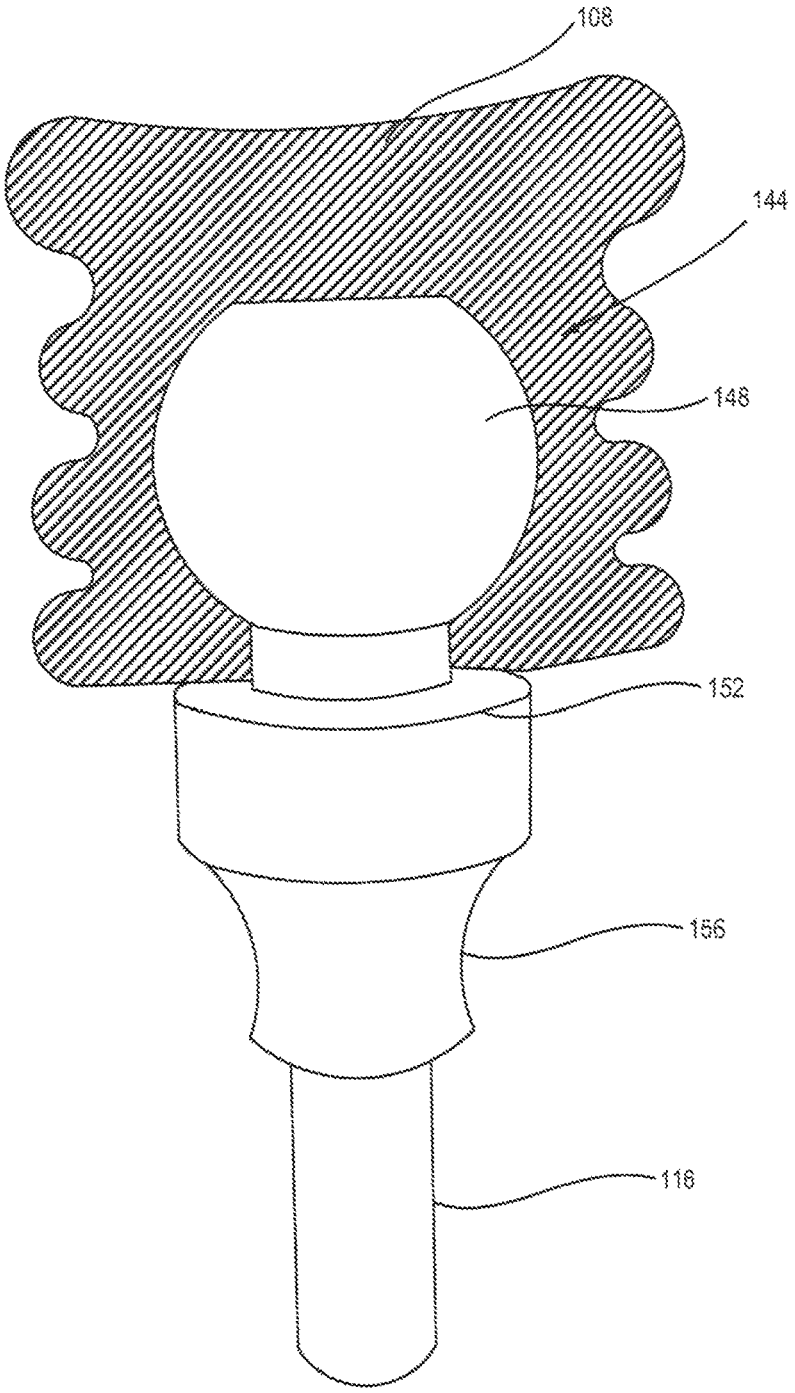
FIG. 7 PRIOR ART
FIG. 7 is a side elevation view of an illustration of a prior art string stopper system.

Each bumper portion 108 is adapted to be secured to a corresponding support member. In the present situation, the bumper portion 108 is adapted to be secured to the proximal end 140 of the second support member 116. In the present embodiment shown disassembled in FIG. 6, the proximal end 140 is equipped with a bumper portion connector 144 sized and designed to mate and secure thereon the bumper portion 108. The bumper portion connector 144 is generally made of a material that can sustain mechanical loads and shocks from the string 32. Materials such as steel or aluminum are generally acceptable. The bumper portion connector 144 has a spherical shape 148 transitioning into a lip 152 and further transitioning with a curved portion 156 to an elongated rod 160. FIG. 7 provides an illustration of bumper portion connector 144 assembly. As it can be appreciated, the interior of the rubber bumper portion 108 is shaped and designed to match the shape of the bumper portion connector 144. The bumper portion 108 is assembled over the bumper portion connector 144 leaving no gap therebetween to secure the bumper portion 108 to the bumper portion connector 144. The shape and the size of the bumper portion connector 144 is adapted to copy the shape and the size of the bumper portion 108. The bumper portion 108 is pressed against the spherical shape 148 to stretch the opening of the bumper portion 108 and insert the spherical shape 148 therein. Once the spherical shape 148 is inserted inside the bumper portion 108, the bumper portion 108 substantially gets back to its original shape and retention of the bumper portion 108 is made by the smaller diameter of the bumper portion 108 opening. Other configuration of parts can be used to secure bumper portions 108 to a crossbow 10, however, the exemplified embodiment in FIG. 5, FIG. 6 and FIG. 7 are representative of available commercial products.

Figure 8:
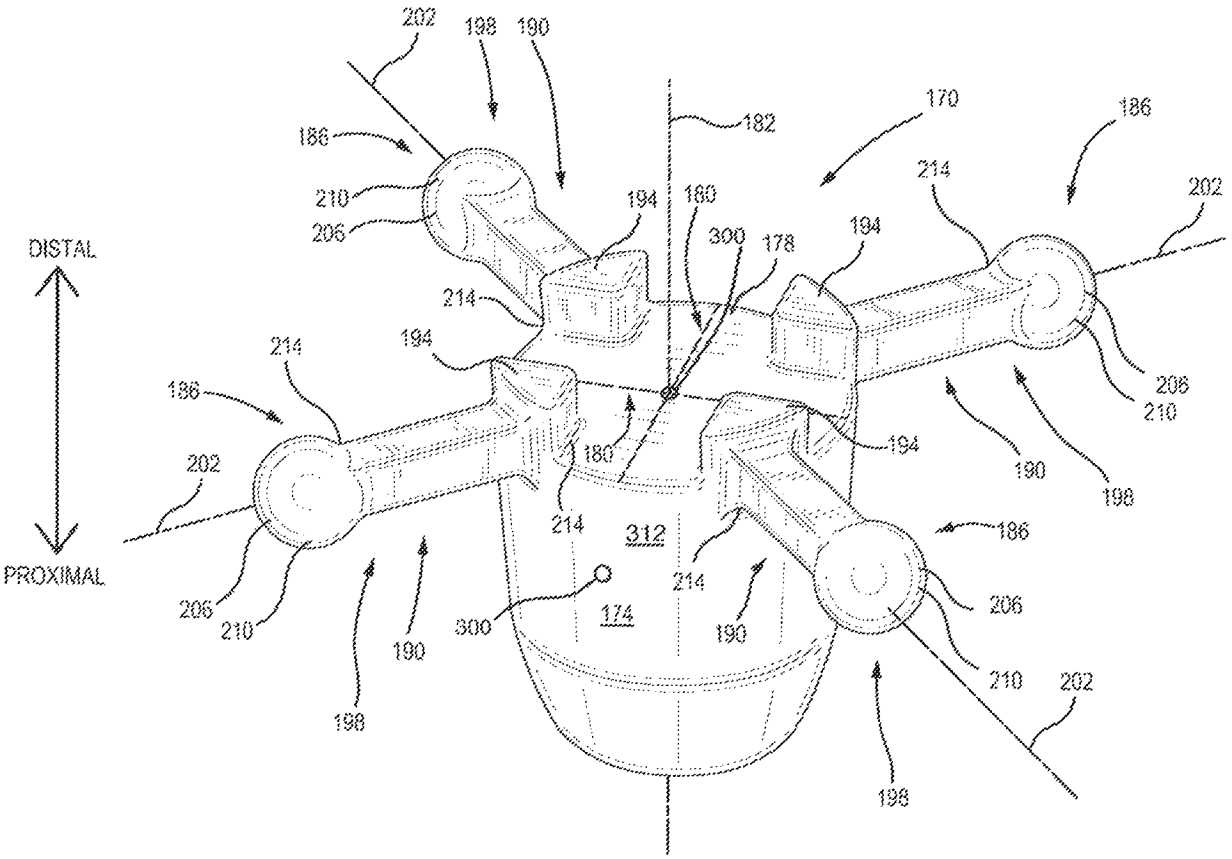
FIG. 8 is a side elevation view of an illustration of a string bumper in accordance with at least one embodiment of the present invention.
Figure 9:
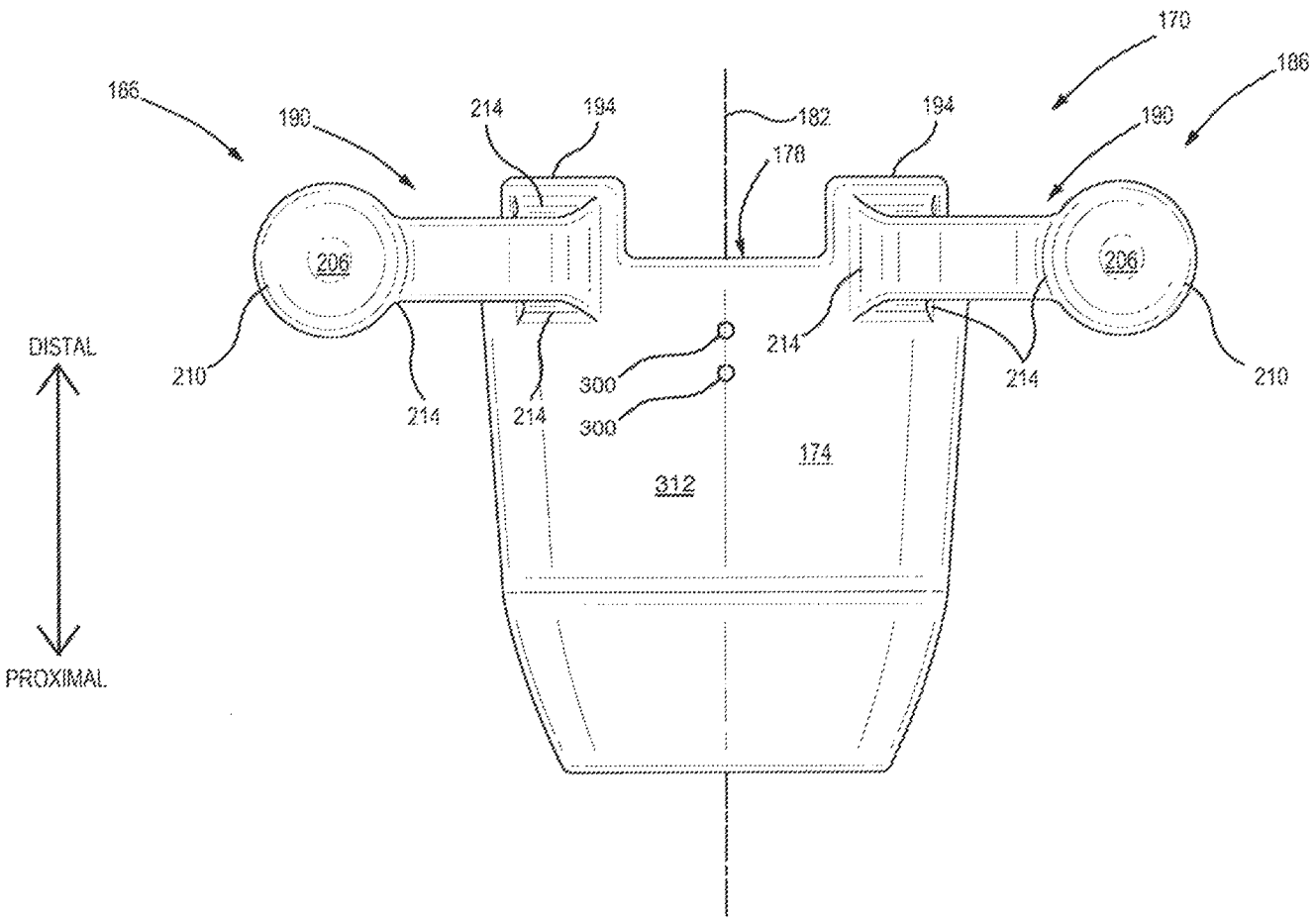
FIG. 9 is a side elevation view of an illustration of a string bumper in accordance with at least one embodiment of the present invention.
Figure 10:
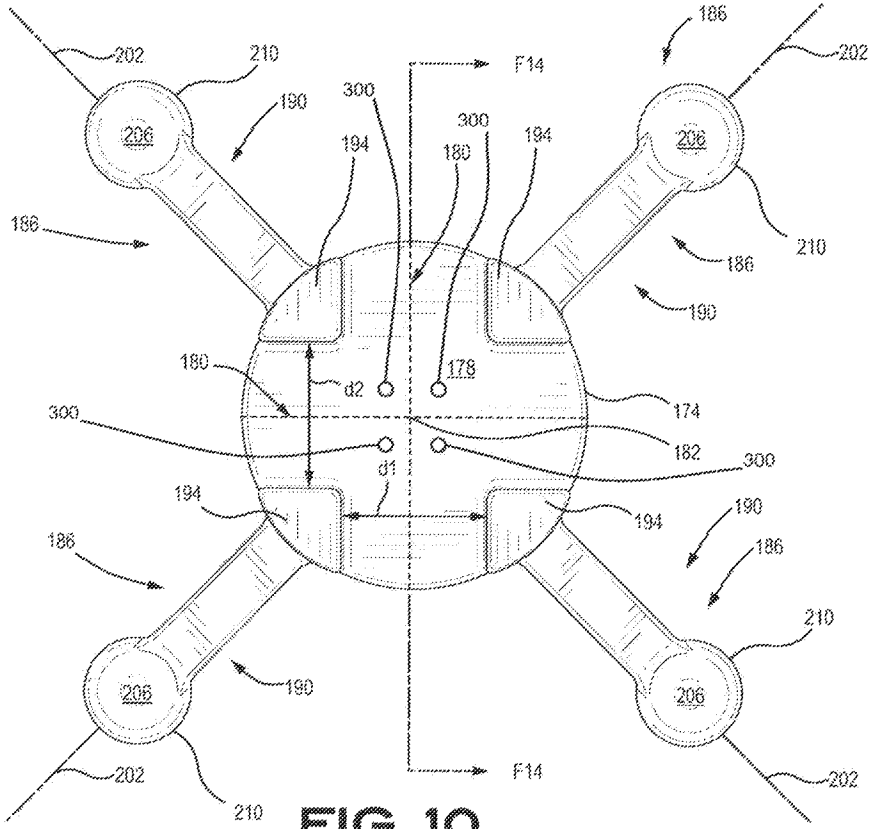
FIG. 10 is a top plan view of an illustration of a string bumper in accordance with at least one embodiment of the present invention.

Now, in reference with FIG. 8 throughout FIG. 10, a string bumper 170 in accordance with an embodiment of the invention is presented. The exemplified string bumper 170 includes a body 174 made of a material suitable to absorb shocks from the moving string 32 (the string 32 is not illustrated in FIG. 8 throughout FIG. 10). A suitable material could be a polymer material, like natural rubber, having a duro (shore A) of about between 20 and 70, for instance. Different duros could be used to achieve a desired dampening behavior without departing from the scope of the invention although a duro of about between 30 and 60 appears to be effective and a duro of about 45 could be optimal depending on the final design, thickness, shape, size and use. For instance, a bow 120 has about 65 pounds of pressure and could require a softer duro while a crossbow 10 could use up to 300 pounds of pressure and would require a harder duro. The body 174 comprises a string-contacting surface 178 adapted to contact the string 32 preferably along string contact axes 180. The string-contacting surface 178 is preferably planar to prevent influencing the movement of the string 32, which could influence the trajectory of the arrow 26; a curved or angled surface might influence the direction of the arrow 26 with a non-orthogonal contact with the string 32 but are nonetheless within the scope of the present invention. The body 174 of the illustrative string bumper 170 is cylindrical about axis 182, however, other shapes are possible and contemplated in the present application.

The string bumper 170 is optionally equipped with a plurality of vibration dampers 186. The number, the size, shape and position of the vibration dampers 186 can vary without departing from the scope of the present invention. As embodied, four (4) vibration dampers 186 are provided with the string bumper 170. Each vibration damper 186 is embodied with an elongated portion 190 extending in cantilever from a side of the string bumper 170 and ending with an optional mass 206 embodied in a spherical shape 210. The exemplified vibration dampers 186 are extending from the outside periphery of the body 174 in a substantially perpendicular fashion thereof. The vibration dampers 186 partly extend from protruding portions 194 axially raising from the body 174 and offering additional damping capability to the assembly. The protruding portions 194 are embodied in a particular configuration without prejudice or disclaimer and other analogous designs thereof are considered to remain within the scope of the instant invention. Distances $d_1$ and $d_2$ between adjacent protruding portions 194 are sized to provide sufficient string contacting surface 178 to functionally receive the string 32. The distances $d_1$ and $d_2$ between adjacent protruding portions 194 could be different than the one illustrated, of different from one another if desirable to obtain specific behaviors.

Crossbows 10 are generating significant vibrations when releasing the energy stored in the limbs 66 for propelling an arrow 26. However, a low level of noise is preferable when hunting. The string bumper 170 helps reduce the amount of vibrations and can optionally include a plurality of vibration dampers 186 thereon to further help reduce the amount of vibrations that could translate into audible noises. In a possible embodiment exemplified in FIG. 8 throughout FIG. 10, extending elements 198 can be used as vibration dampers 186 and be associated with the string bumper 170 for reducing the vibration level of the crossbow 10. In the present embodiment, the vibration dampers 186 are manufactured with the string bumper 170 and located near the distal end of the string bumper 170 to dissipate vibrations traveling toward the ends of the string bumper apparatus 100 before they transform into audible noise. Another embodiment would removably assemble the string bumper 170 and the vibration dampers 186 hence allowing easy removal of the vibration dampers 186. It remains within the scope of the present application to add, remove and change the configuration, the number and the locations of the vibration dampers 186 on the string bumper 170 to adapt to specific factors and designs.

The vibration damper 186 is preferably made of vibrations dampening material like rubber. The vibration damper 186 is designed with an elongated shape along respective longitudinal axis 202 thereof. The vibration damper 186 can be embodied in various longitudinal lengths in accordance with its position on the string bumper 170. A soft rubber, polymer or elastomer having sufficient elasticity is preferable to ensure strong contact and proper positioning on the string bumper 170. The contact with the string bumper 170 needs to be sufficient to allow proper vibration dampening.

The vibration damper 186 includes an elongated portion 190 extending from the string bumper 170 to oscillate and further dissipate vibrational energy with its flexible construction and lower the noise that could be caused by the release of tension in the string 32, the propulsion of the arrow 26 and the string 32 contact with the string bumper 170. The elongated portion 190 is embodied supporting an optional mass 206 disposed at a distance from the body 174 of the string bumper 170; the mass 206 is illustratively embodied as a spherical shape 210. The elongated portion 190 is connected to the body 174 of the string bumper 170 by the optional axial protruding portion 194. The elongated portion 190 preferably has a reduced section compared to the body 174 of the string bumper 170 to efficiently transmit vibrations in the vibration damper 186. In turn, the mass 206 preferably has a larger size than the elongated portion 190 to include more material ensuring efficient vibration absorption. Despite the mass 206 is embodied as a generally spherical shape 210 in the present embodiment, other shapes and sizes are contemplated by the present application. A series of radiuses 214 are managing soft transitions between the different sides of the vibration damper 186 and to prevent local stress concentration in addition to providing a fluid design.

The vibration dampers 186 is acting as an energy harvesting structure that can harvest energy from the vibrations caused by the functioning of the crossbow 10. The harvesting of mechanical energy from vibrations is using inertial energy harvesting that generally relies in the resistance of a mass to acceleration, and kinematic energy harvesting which directly couples the energy harvester to the relative movement of the source, the crossbow 10. The damping effect of the string bumper 170 and the vibration damper 186 of embodiments therein is mainly provided by the viscoelastic character of polymers. Elastomer and rubber are also used as vibration damping material due to their viscoelasticity.

Figure 11:
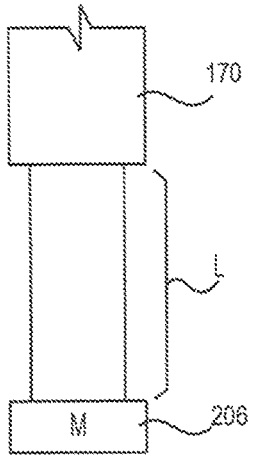
FIG. 11 is a schematic illustration of spring-mass damper configuration in accordance with an embodiment of the present invention.
Figure 12:
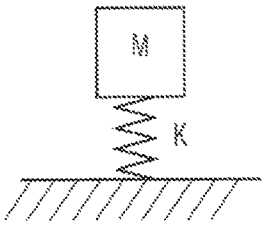
FIG. 12 is a schematic illustration of spring-mass damper configuration in accordance with an embodiment of the present invention.
Figure 13:
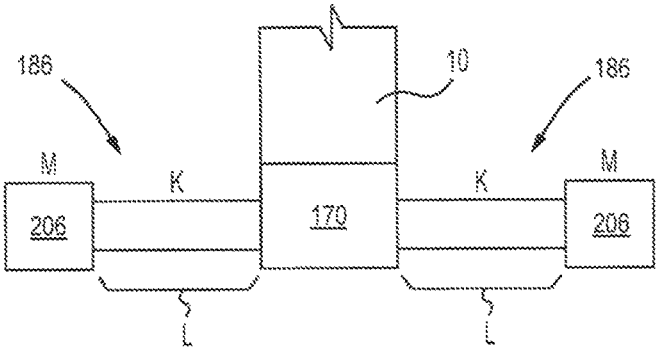
FIG. 13 is a schematic illustration of a double spring-mass damper configuration in accordance with an embodiment of the present invention.

The string bumper 170, the vibration damper 186 and the crossbow 10 structure, independently and collectively can be seen as a spring designs for use in vibration absorbers. The structure offers a very simple realization of a spring-mass system for use as a vibration absorber. Such a mass-ended cantilevered beam is illustrated schematically in FIG. 11 where the cantilever vibration damper 186 is connected to the string bumper 170. The hence considered mass-ended cantilevered beam may be treated as a simple lumped-mass "sdof" (single degree of freedom) system as shown in FIG. 12 having a mass M and a spring stiffness K. The conceptual vibration absorber can also be refined to consider two or more vibration dampers 186 extending distally from the string bumper 170, which in turn extends from the crossbow 10 as schematically illustrated in FIG. 13 as cantilever vibration absorbers.

The vibration damper 186 is embodied with material having vibration absorption/damping capability. In an embodiment, Vistalon™ ethylene propylene diene (EPDM) rubber is used. Performance advantages of Vistalon™ EPDM include ozone resistance, excellent electrical insulation, long service life in extreme environmental conditions and sustained flexibility. Vistalon™ EPDM can be loaded with high levels of filler for cost-effective compounding. It is UV resistant and can sustain wide temperature variations. An embodiment uses EPDM with 50 Shore A hardness to allow vibration absorption/damping. In another embodiment, natural rubber is used. An embodiment uses natural rubber with 50 shore A hardness. In another embodiment, silicon is used. An embodiment uses silicon with 50 shore A hardness. In another embodiment, nitrile is used. An embodiment uses nitrile with 50 shore A hardness. Alternatively, the material in use can have a duro varying from 30 to 60 to obtain a desired damping, depending on the configuration of the crossbow 10 and components thereof. Other materials capable of providing proper absorption/damping of vibrations are also contemplated by the present invention. Generally, the material should be mate and of dark color, finish that can be considered "tactical", to prevent undesired light transmission when hunting, although other colors are also encompassed by the present application.

Illustratively, an array of four vibration dampers 186 is illustrated in FIG. 8 throughout FIG. 10. Other configurations using a different number of vibration dampers 186 are within the realm of the present application. The number of vibration dampers 186 can be adjusted in function of the location of the string bumper 170 on the crossbow 10, the quantity of vibrations to damp, the required mass 206, the type of material used to manufacture the vibration dampers 186 and its intrinsic material properties, among other parameters.

Figure 14:
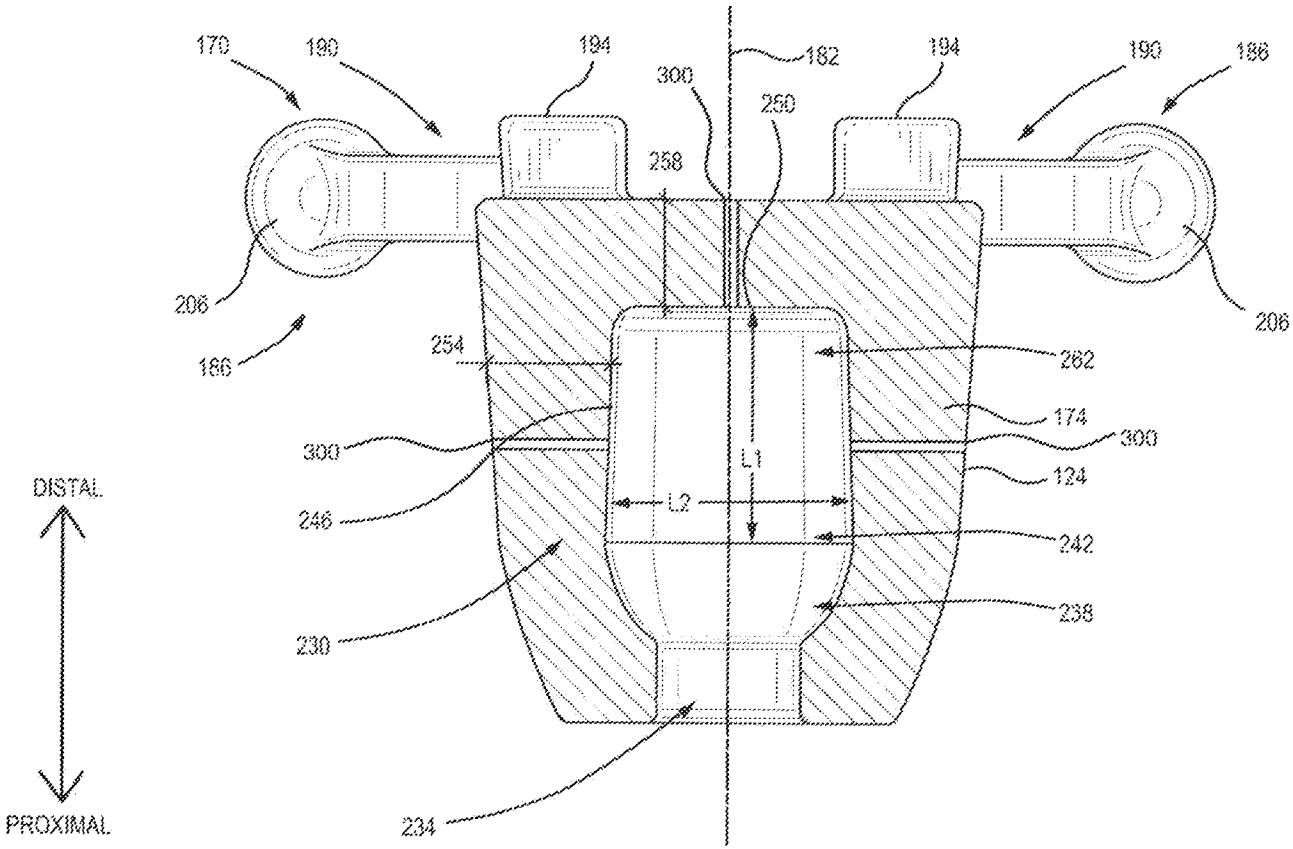
FIG. 14 is a section side elevation view of an illustration of a string bumper in accordance with at least one embodiment of the present invention.

FIG. 14 illustrates another embodiment of the invention that can be used individually or collectively with other embodiments described therein. Indeed, a section view of the string bumper 170 can be appreciated in FIG. 14. The string bumper 170 includes a hollowed interior portion 230 adapted to receive and secure a bumper portion connector 144 (not illustrated in FIG. 14 but depicted in FIG. 6 and FIG. 21). The hollowed portion 230 includes an opening portion 234, adjacent with the radial exterior surface of the body 124, and aligned with the axis 182 of the string bumper 170. The opening portion 234, illustrated with a cylindrical shape of a diameter of about 6.3 mm (¼") for receiving and sealing therein a larger support rod of, illustratively, about 9.5 mm (⅜") is followed by an expansion portion 238 that is generally larger than the opening portion 234. The opening portion 234 and/or the expansion portion 238 are sized and designed to capture and seal the bumper portion connector 144 therein. A damper portion 242 with a volume adapted to trap air (or a gas) therein to act as a pneumatic damper to be compress, damp and absorb vibrations created by the string 32 when the string 32 contacts the string bumper 170 upon release of the tension in the limbs 66. The damper portion 242 is located further inside the hollowed portion 230 of the string bumper 170. The opening portion 234, and/or the expansion portion 238, are sized and designed to prevent air to circulate between the damper portion 242 and the environment. A tight fit is desirable to allow the damper portion 242 to act as an air cushion that is further damping the shock caused by the contact of the string 32. The damper portion 242 has a larger volume than the volume used by the bumper portion connector 144 (best seen in FIG. 7) to create a volume of air 262 therein when assembled with the bumper portion connector 144. The size of the air volume 262 can be designed to be larger or smaller in accordance with the required desired damping effect. The interaction between the damper portion 242 and the bumper portion connector 144 will be discussed in greater details later in the description. Other shapes and sizes of the components can vary without departing from the scope of the present disclosure. For instance, a rod or a bumper portion connector 144 of a different shape used in conjunction with a larger internal volume suitable to act as a damper portion 242 is contemplated by the present description.

The damper portion 242 includes a transversal length that is larger than the transversal length of the opening portion 234 to provide a volume variation when the string 32 contacts the string-contacting surface 178. A small volume would require a stronger force to create the same volume variation. The damper portion 242 has a longitudinal length adapted to allow a hollowed volume of air when the string damper 170 is operatively secured to the projectile-accelerating apparatus. The internal longitudinal length $L_1$ of the damper portion 242 is larger than the diameter of the opening portion 234 in an embodiment. The internal longitudinal length $L_1$ of the damper portion 242 is about 1.5 times larger than the diameter of the opening portion 234 in another embodiment. The internal longitudinal length $L_1$ of the damper portion 242 is about 2 times larger than the diameter of the opening portion 234 in one other embodiment. Concurrently, the internal transversal length $L_2$ of the damper portion 242 is larger than the diameter of the opening portion 234 (typically about ¼" diameter) in an embodiment. The internal transversal length $L_2$ of the damper portion 242 is about 1.5 times larger than the diameter of the opening portion 234 in another embodiment. The internal transversal length $L_2$ of the damper portion 242 is about 2 times larger than the diameter of the opening portion 234 in one other embodiment. The internal transversal length $L_2$ of the damper portion 242 is about between 2.5 to about 3 times larger than the diameter of the opening portion 234 in another embodiment. The internal transversal length $L_2$ of the damper portion 242 can also be about more than 3 times larger than the diameter of the opening portion 234 in another embodiment.

The illustrated damper portion 242 has, for example, cylindrical lateral walls 246 connecting to a distal wall 250. More precisely, the exemplified damper portion 242 has lateral walls 246 of substantially even thickness connecting to a substantially flat distal wall 250. The thickness 254 of the lateral walls 246 and the thickness 258 of the interior distal wall 250 can vary between 1 mm to 10 mm depending of the desired damping effect and in conjunction with the type of material used to manufacture the string bumper 170. The interior distal wall has a thickness 258 of about between 2 mm and 10 mm, preferably a thickness of about between 4 mm and 8 mm and more preferably, in context of the present embodiment, about between 5 mm and 7 mm. The thickness 254 of the lateral wall 246 is about between 2 mm and 10 mm, preferably a thickness of about between 4 mm and 8 mm and more preferably, in context of the present embodiment, about between 5 mm and 7 mm.

Figure 15:
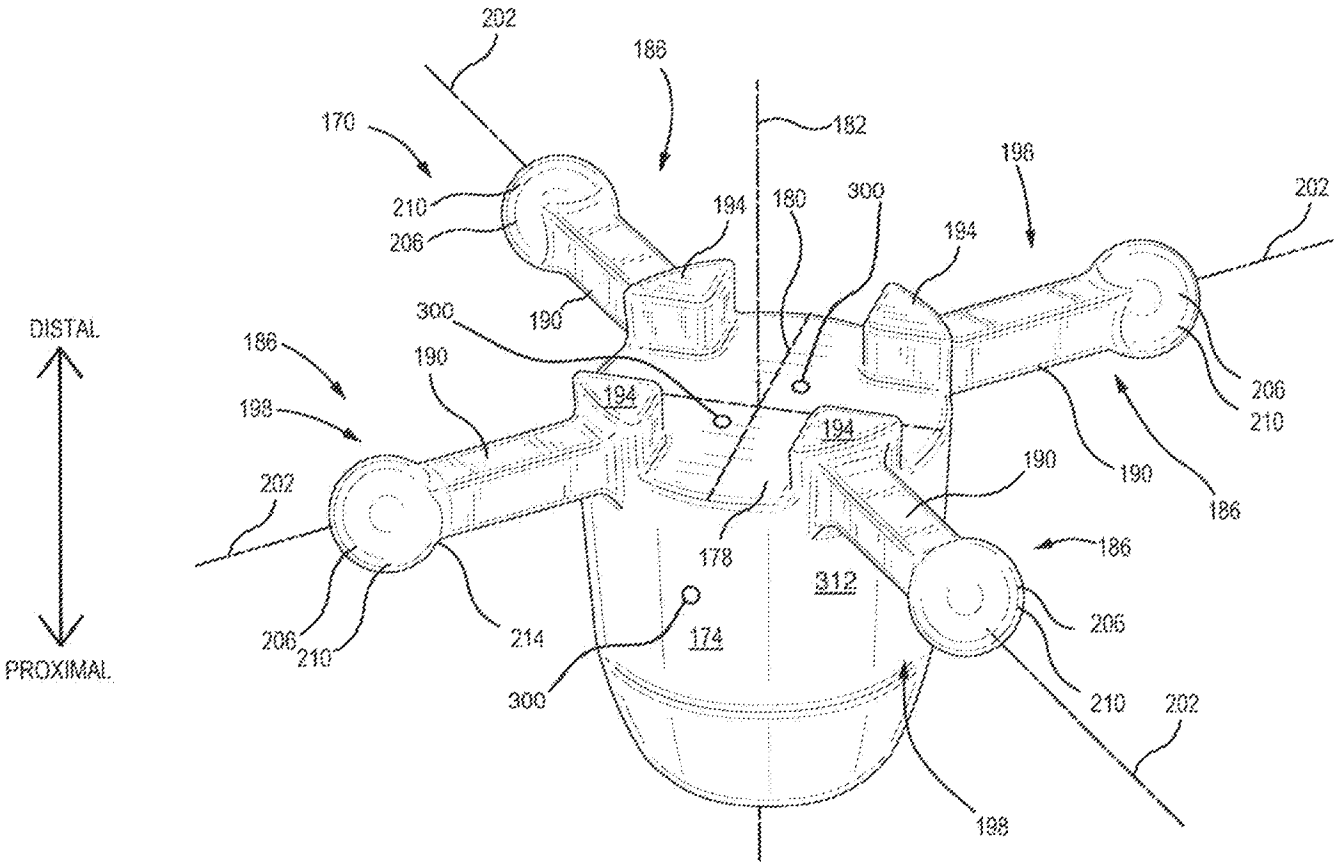
FIG. 15 is a perspective view of an illustration of a string bumper in accordance with at least one embodiment of the present invention.
Figure 16:
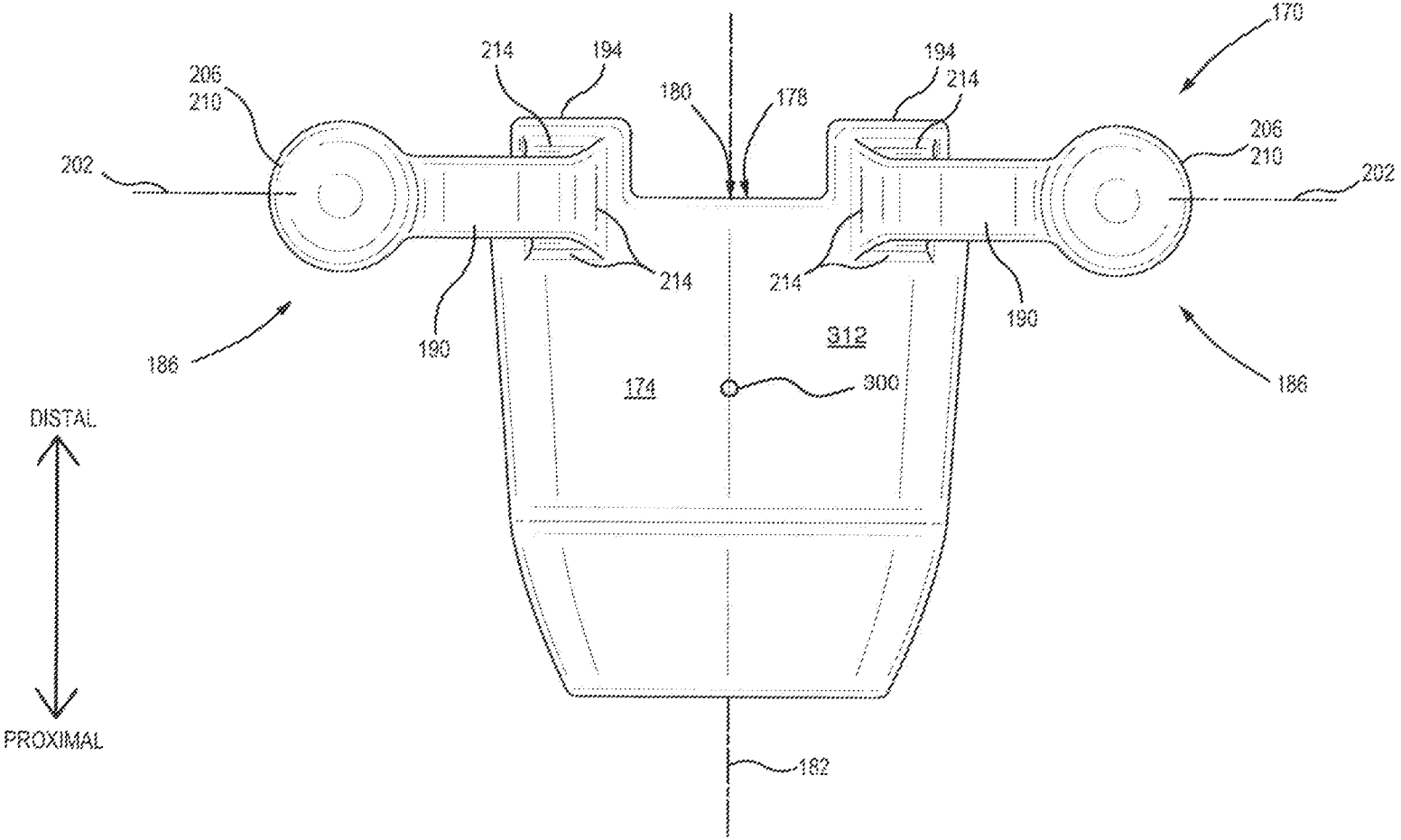
FIG. 16 is a side elevation view of an illustration of a string bumper in accordance with an embodiment of the present invention.
Figure 17:
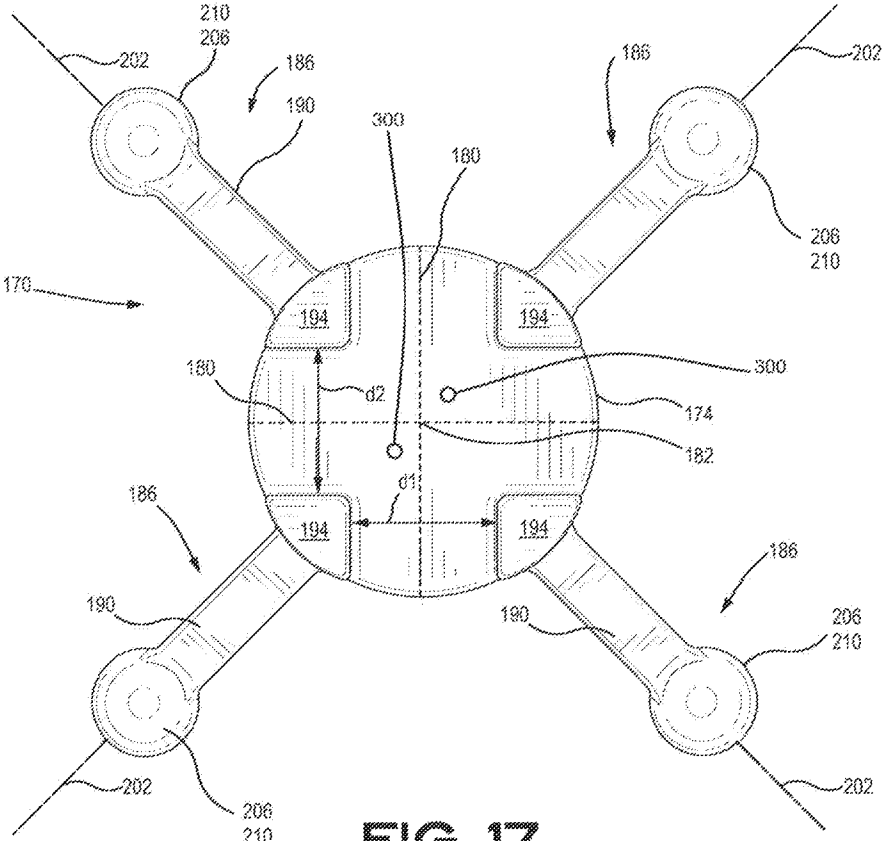
FIG. 17 is a top plan view of an illustration of a string bumper in accordance with at least one embodiment of the present invention.

Moving now to FIG. 15, FIG. 16 and FIG. 17 illustrating an alternate embodiment of a string bumper 170 having protruding portions 194 of different size. The protruding portions 194 of FIG. 15, FIG. 16 and FIG. 17 are larger than the protruding portions 194 of the embodiment illustrated in FIG. 8 throughout FIG. 10. The size of the string contacting surface 178 is thus smaller as illustrated by smaller distances $d_1$ and $d_2$ but is large enough to receive the string 32 without contacting the protruding portion 194 even if the string contacting surface 178 is reasonably misaligned of about between 0 and 45 degrees angle with the string 36 when illustratively rotating the string bumper 170. The damping effect of the string bumper 170 is hence going to be influenced by the different material distribution.

Figure 18:
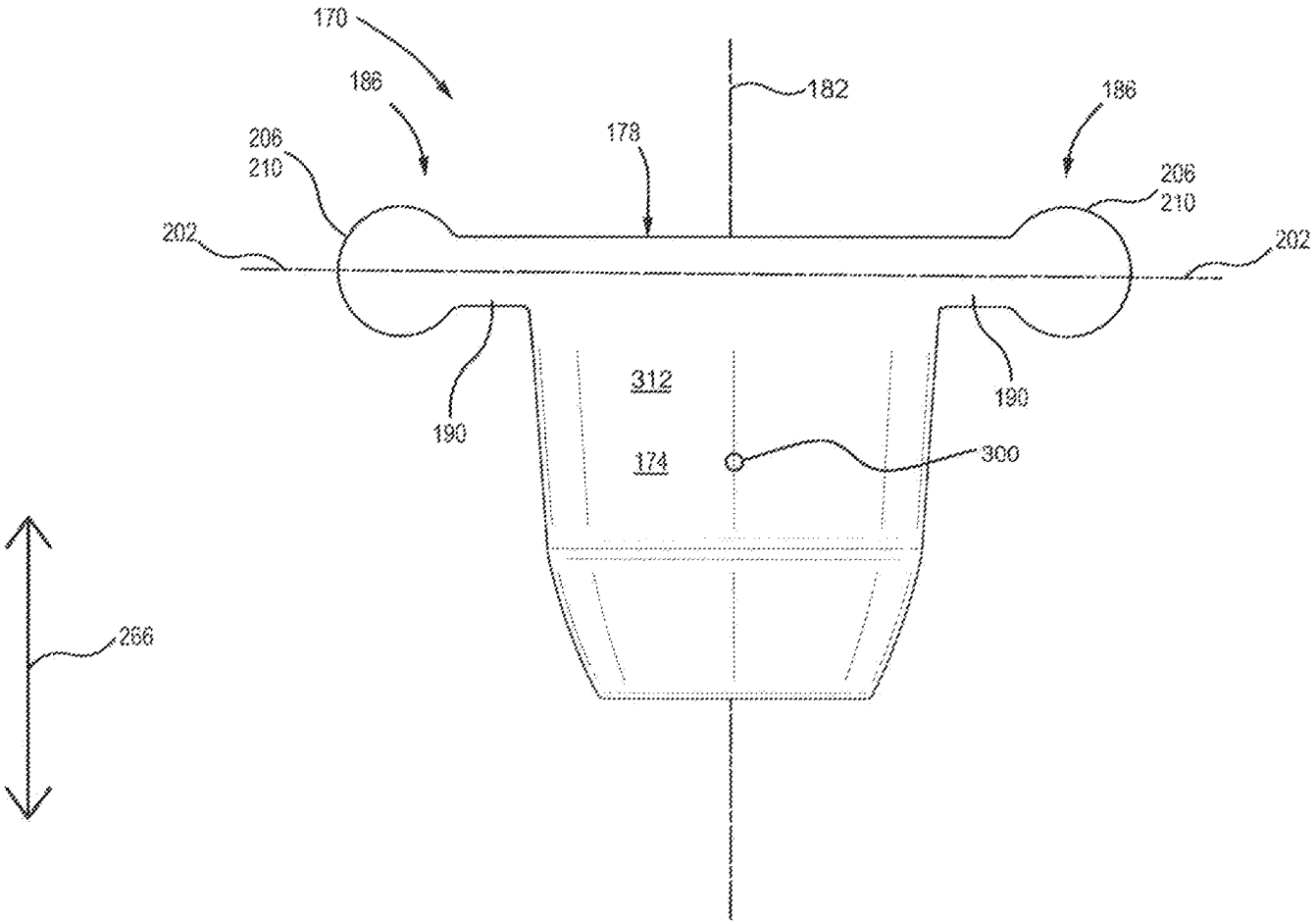
FIG. 18 is a side elevation view of an illustration of a string bumper in accordance with at least one embodiment of the present invention.

In other possible embodiments, the location of the vibration dampers 186 can be set differently along 266 the exterior wall of the string bumper body 174 to further adjust the damping efficiency of the vibration dampers 186. The string bumper 170 can also be embodied without the protruding portions 194 as it is illustrated in FIG. 18.

Figure 19:
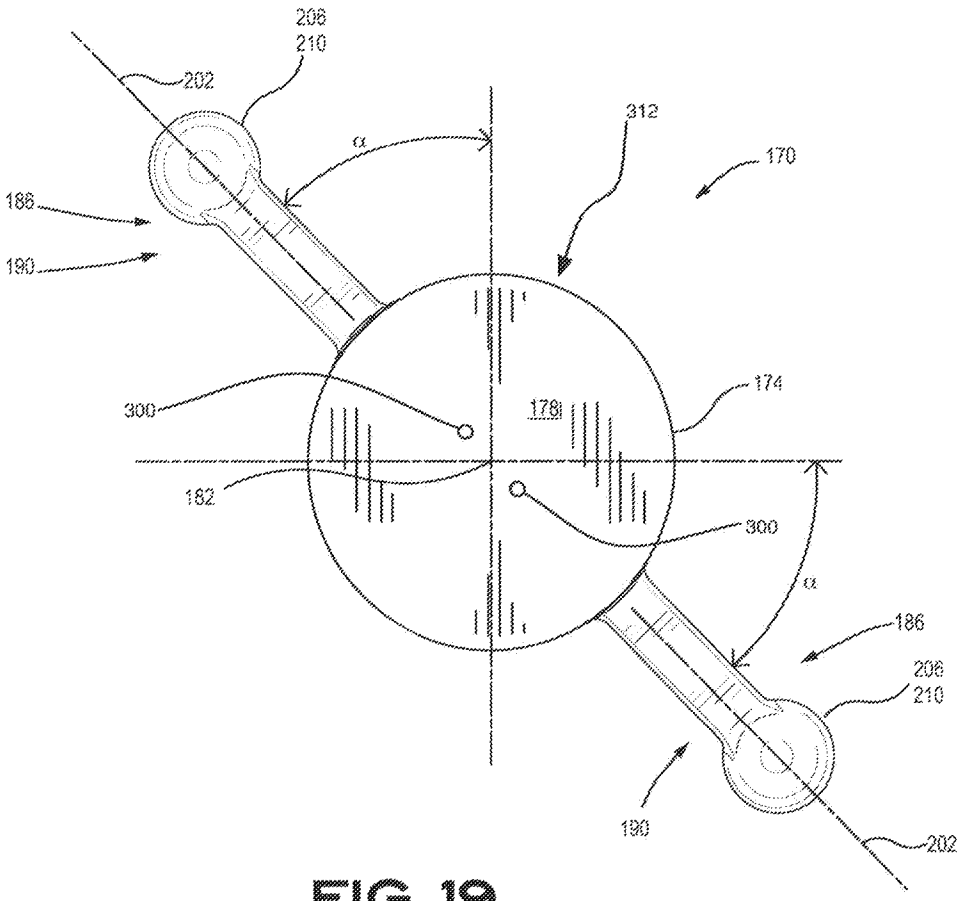
FIG. 19 is a top plan view of an illustration of a string bumper in accordance with at least one embodiment of the present invention.
Figure 20:
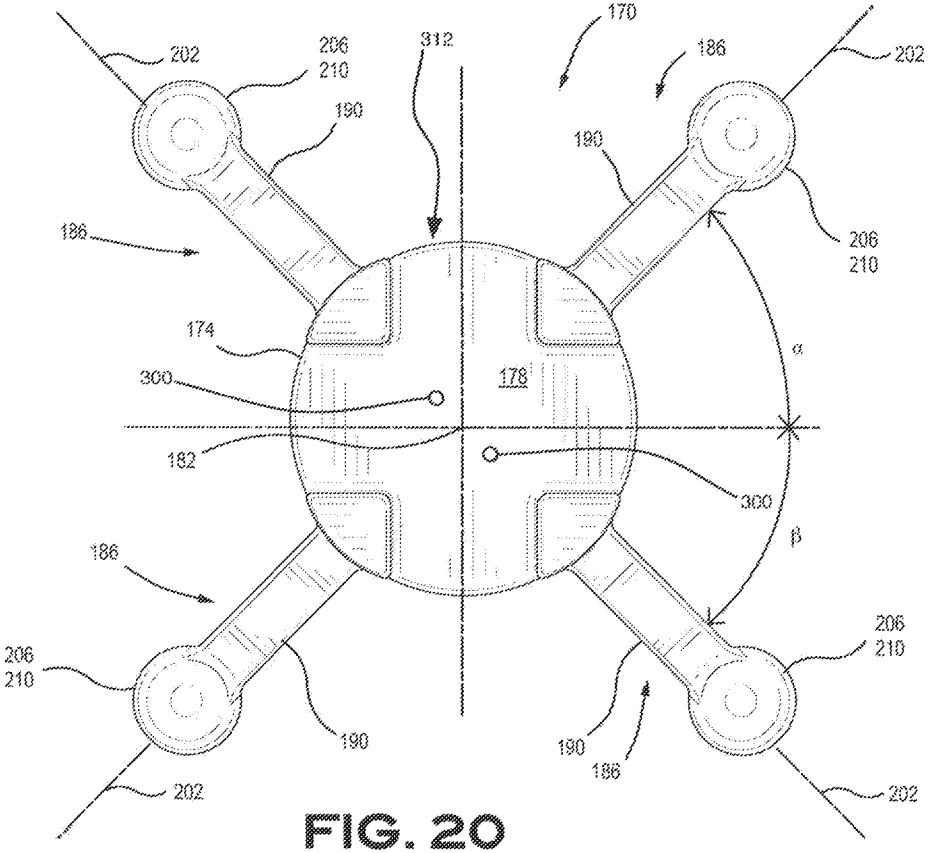
FIG. 20 is a top plan view of an illustration of a string bumper in accordance with at least one embodiment of the present invention.

FIG. 19 depicts a string bumper 170 with only two vibration dampers 186 and where the vibration dampers 186 are adapted to be manufactured with various angles $\alpha$ in respect with the string bumper body 174. The angle between two vibration dampers 186 can be asymmetrical in which angle $\alpha$ is different than angle $\beta$ as depicted in FIG. 20.

Figure 21:
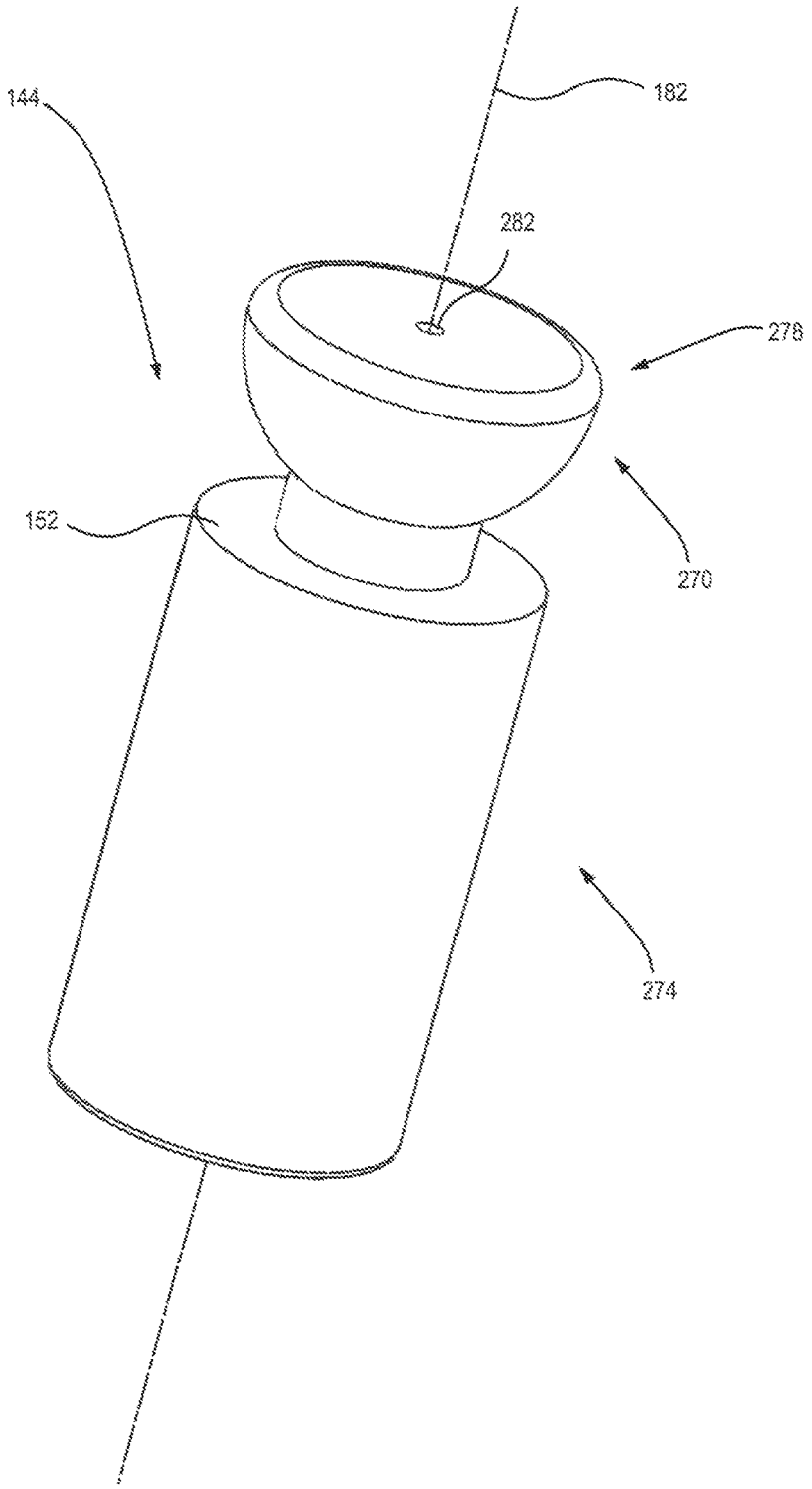
FIG. 21 is a perspective view of an illustration of a bumper portion connector in accordance with at least one aspect of the present invention.
Figure 22:
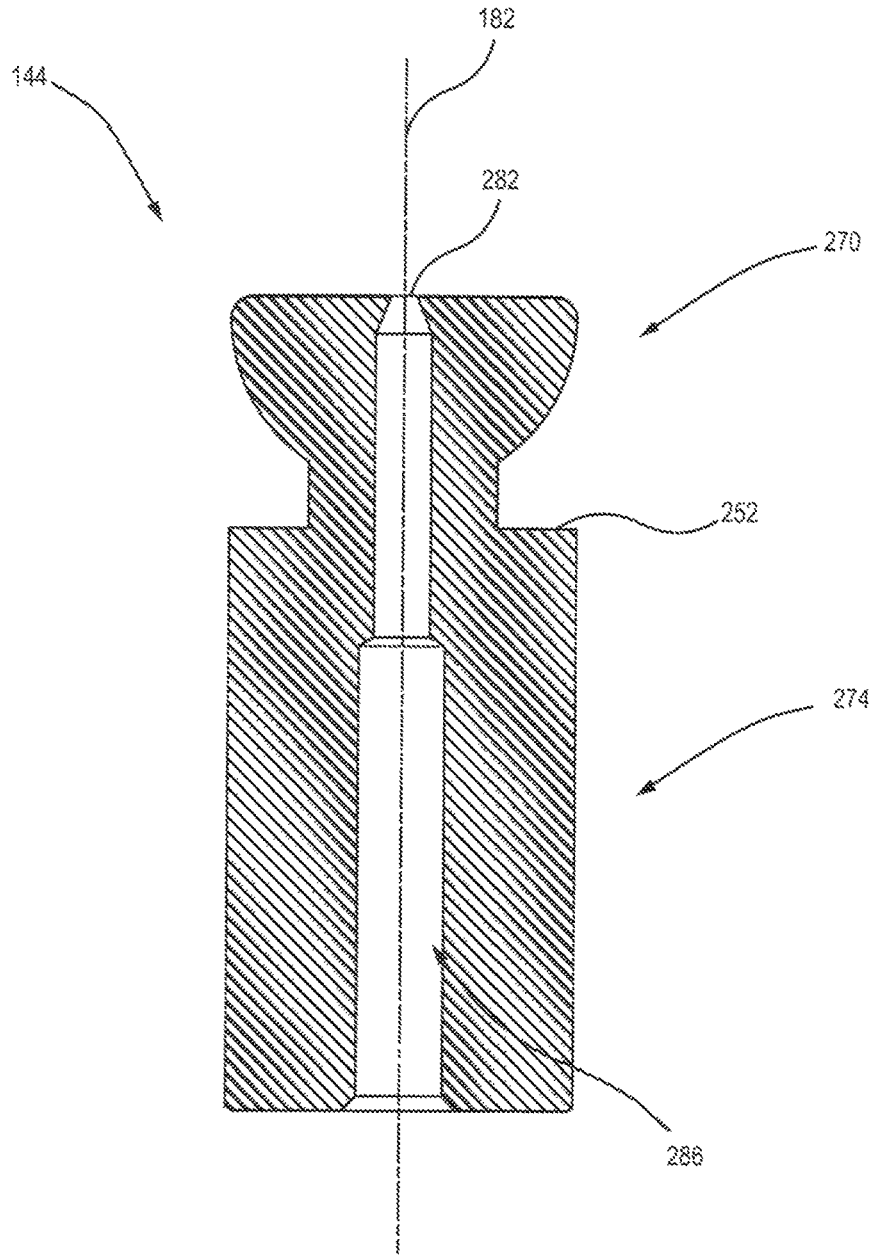
FIG. 22 is an elevation section view of an illustration of a bumper portion connector in accordance with at least one aspect of the present invention.

The interior volume of the string bumper 170 has to be plugged to prevent air from interior volume of the string bumper 170 to escape. A rod (not illustrated) could be used to plug the string bumper 170 opening portion 234 and also secure the string bumper 170 to the arrow-propelling apparatus. FIG. 21 and FIG. 22 are illustrating an alternate embodiment for plugging and securing the string bumper 170 to the projectile-propelling apparatus. A bumper portion connector 144 intended to be fixedly connected to the crossbow 10 to secure thereon the string bumper 170 (not illustrated on these figures) is depicted. The bumper portion connector 144 includes a string bumper receiver 270 on a first side thereof and, on a second side thereof, a connector body 274 sized and designed to interface with associated second support member 116 that can be embodied as the elongated rod 160 illustrated in FIG. 6. The bumper portion connector 144 is adapted to be secured directly to the crossbow 10 or secured indirectly to the crossbow 10 via the elongated rod 160 or any other mechanism providing sufficient mechanical strength. The bumper portion connector 144 can be made of metallic material, from polymeric material or other mechanically suitable materials. It can be appreciated the radial lip 152 is adapted to limit axial movements of the string bumper 170 when the string 32 hits the string bumper 170. The contact between the lip 152 and the corresponding portion of the string bumper 170, when the string bumper 170 is operatively secured to the string bumper receiver 270, is also material in the sealing of the hollowed interior volume of the string bumper 270. The sealing being increased when the string 32 hits the string bumper 270 hence ensuring the hollowed interior volume of the string bumper 270 is not going to let air trapped inside flows to the environment.

One can appreciate in FIG. 21 the string bumper receiver 270 of the bumper portion connector 144 is embodied as a semi-spherical shape 278 as opposed to the spherical shape 148 of the bumper portion connector 144 illustrated in FIG. 6. Still in FIG. 21 and FIG. 22, an optional hole 282 is axially defined through the string bumper receiver 270 to create a channel between the string bumper receiver 270 and a recess 286 therein, better seen in FIG. 22, adapted to receive the elongated rod 160, or other stem design, for securing the string bumper receiver 270 to the crossbow 10. The hole 282 can be used to extract air from the cavity in the string bumper receiver 270 when inserting the elongated rod 160 in the string bumper receiver 270.

Figure 23:
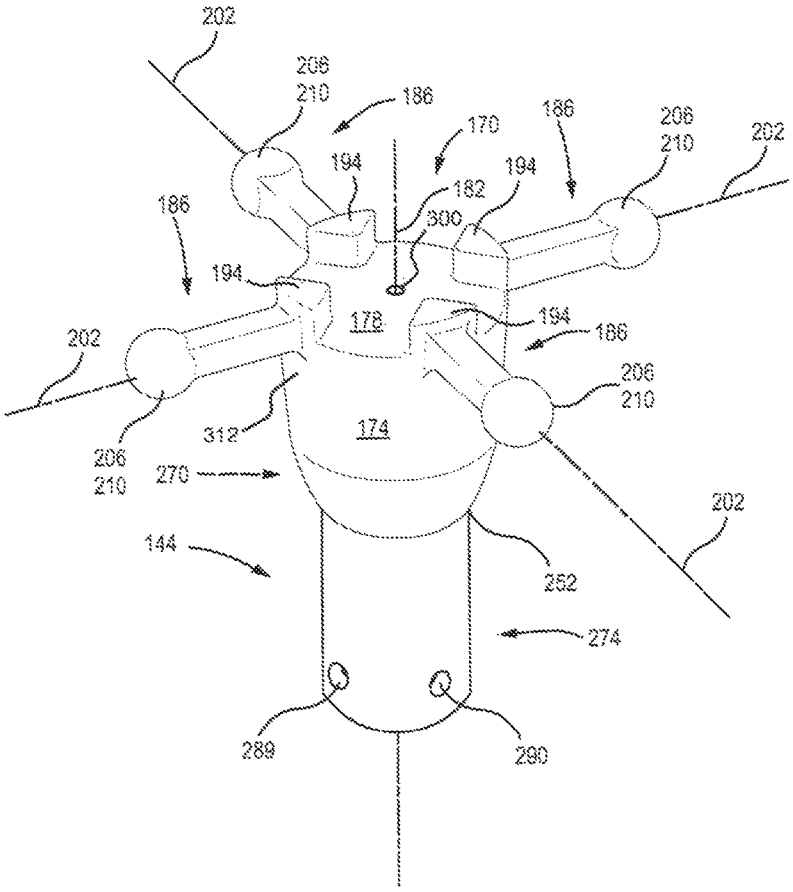
FIG. 23 is a perspective view of an illustration of a bumper portion connector and string bumper assembly in accordance with at least one embodiment of the present invention.
Figure 24:
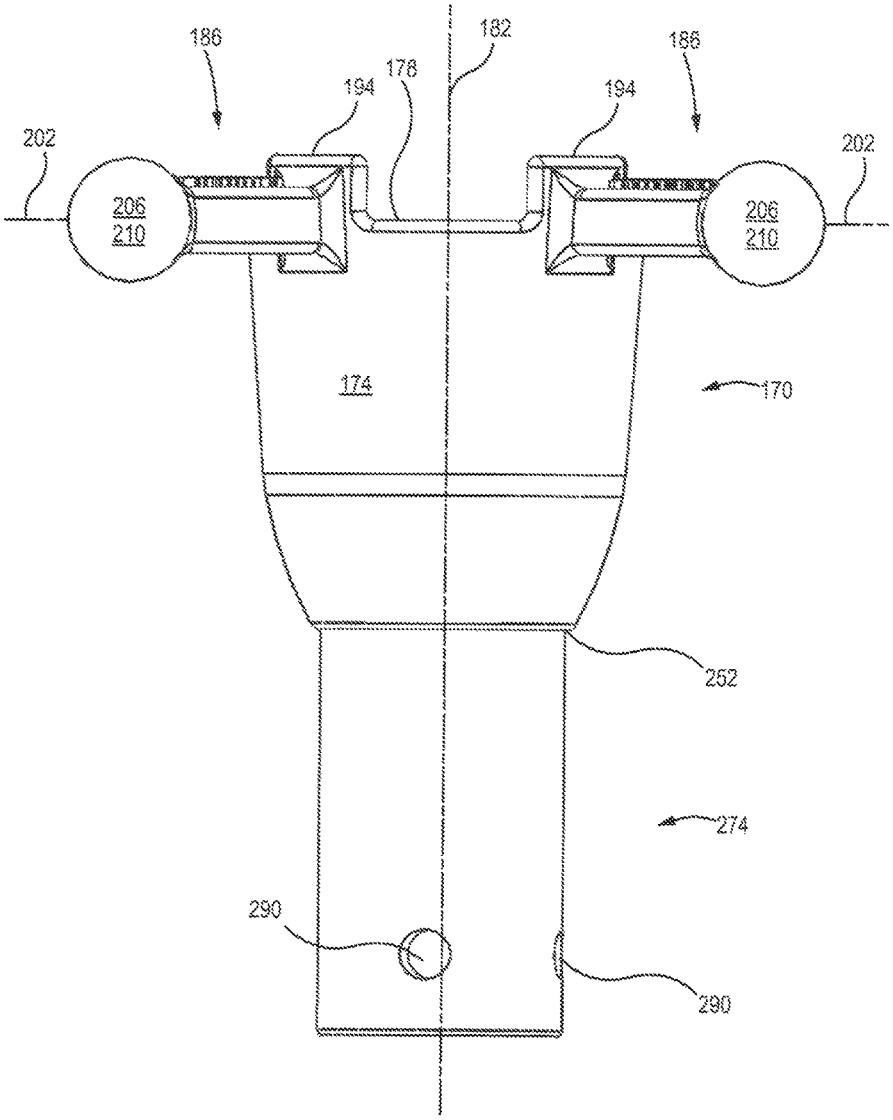
FIG. 24 is a side elevation view of an illustration of a bumper portion connector and string bumper assembly in accordance with at least one embodiment of the present invention.
Figure 25:
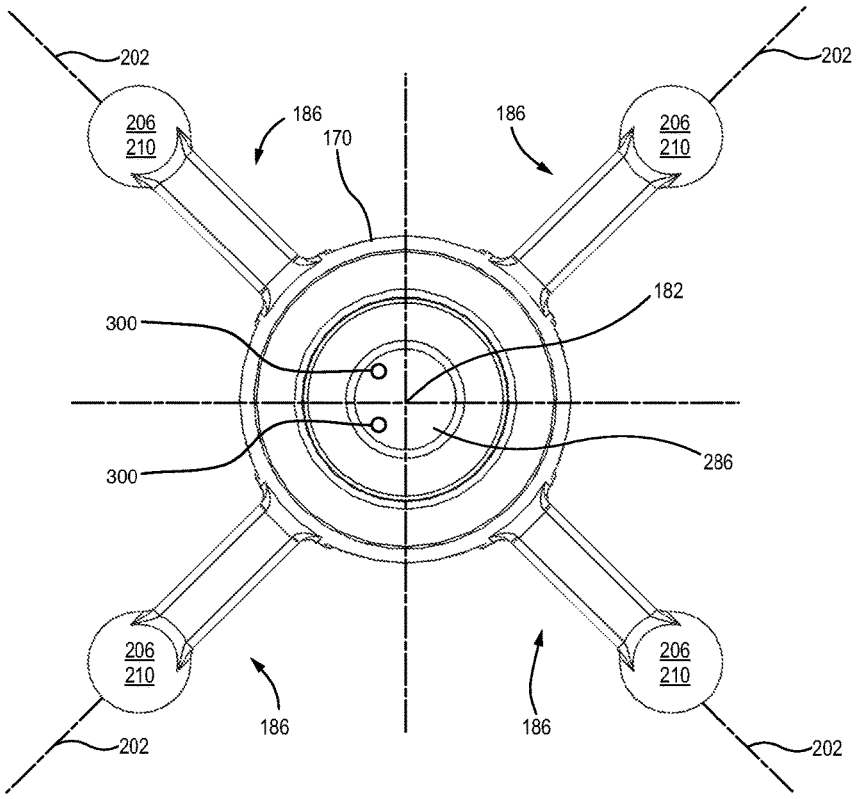
FIG. 25 is a bottom plan view of an illustration of a bumper portion connector and string bumper assembly in accordance with at least one embodiment of the present invention.
Figure 26:
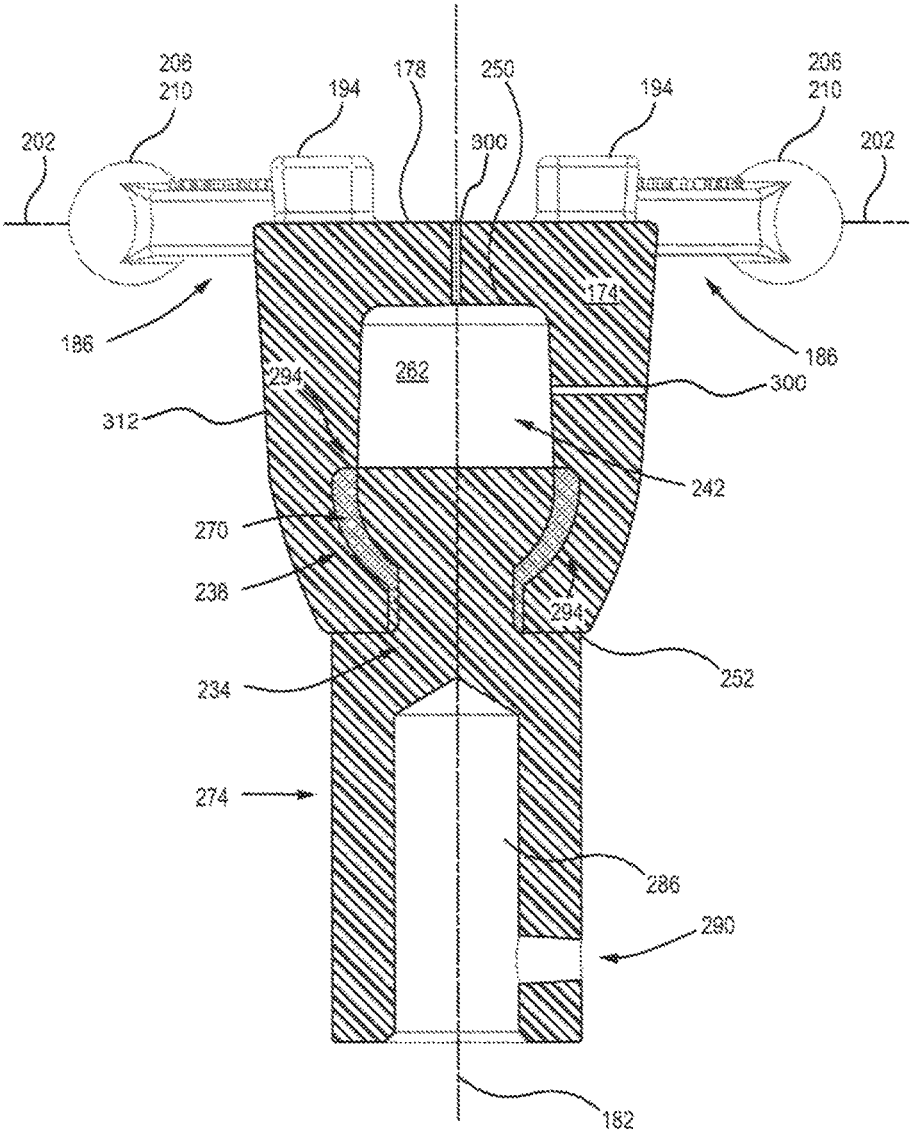
FIG. 26 is a side section elevation view of an illustration of a bumper portion connector and string bumper assembly in accordance with at least one embodiment of the present invention.

An assembly of the string bumper 170 and the bumper portion connector 144 is exemplified in FIG. 23 throughout FIG. 26. It can be appreciated that the connector body 274 includes at least one securing hole 290 for receiving a set screw (not illustrated) or the like, to secure the connector body 274 to the crossbow 10. With more focus on FIG. 26, a press fit portion 294, illustrated with a shaded area, is occurring between the string bumper receiver 270 and the expansion portion 238. Note that the expansion portion 238 in FIG. 26 is illustrated in its relaxed configuration before being stretched by the string bumper receiver 270 to be inserted therein to illustrate, when assembled in cooperation with the string bumper receiver 270, the material stretching at this location. The press fit between the string bumper receiver 270 and the expansion portion 238 is holding the string bumper 170 in place in addition to provide an air-tight fit allowing proper functioning of the enclosed air volume 262.

Figure 27:
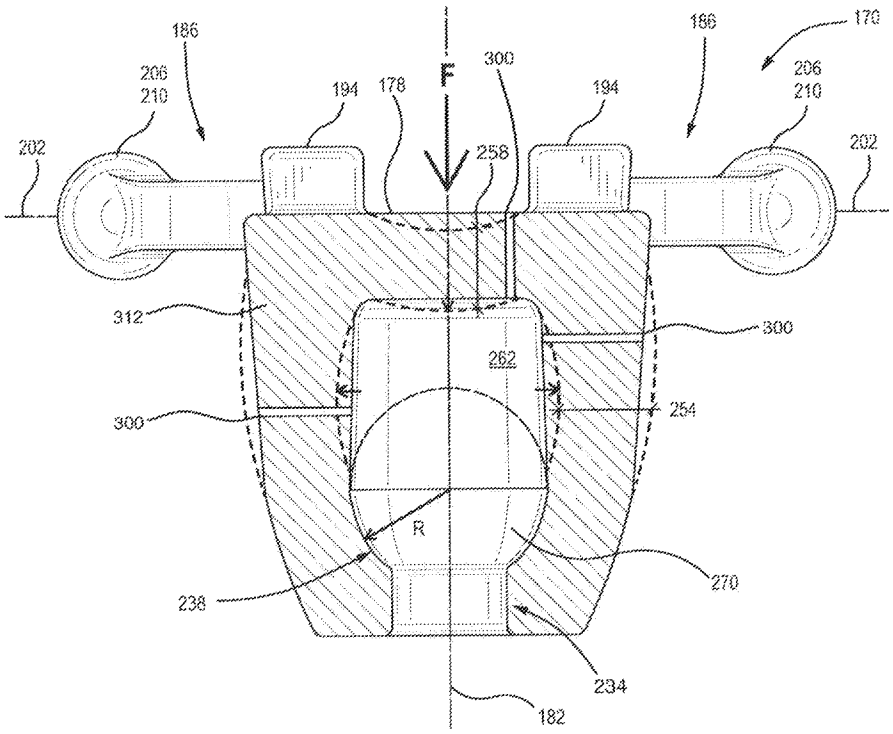
FIG. 27 is a side elevation section view of an illustration of a bumper portion connector and string bumper assembly in accordance with at least one embodiment of the present invention.

Moving now to FIG. 27 that shows a schematic illustration of a string bumper 170 and string bumper receiver 270 assembly on which is applied a force F illustrating the contact of the string 32 on the string-contacting surface 178 when propelling an arrow 26. The force F compresses the air volume 262 trapped in the air volume 262 that is acting as an air damper. The displacement of the walls 254, 258 of the string bumper 170, illustrated by bold dotted portions, is a consequence of the force F applied on the string bumper 170 and the resulting compression of the air trapped in the air volume 262.

Figure 28:
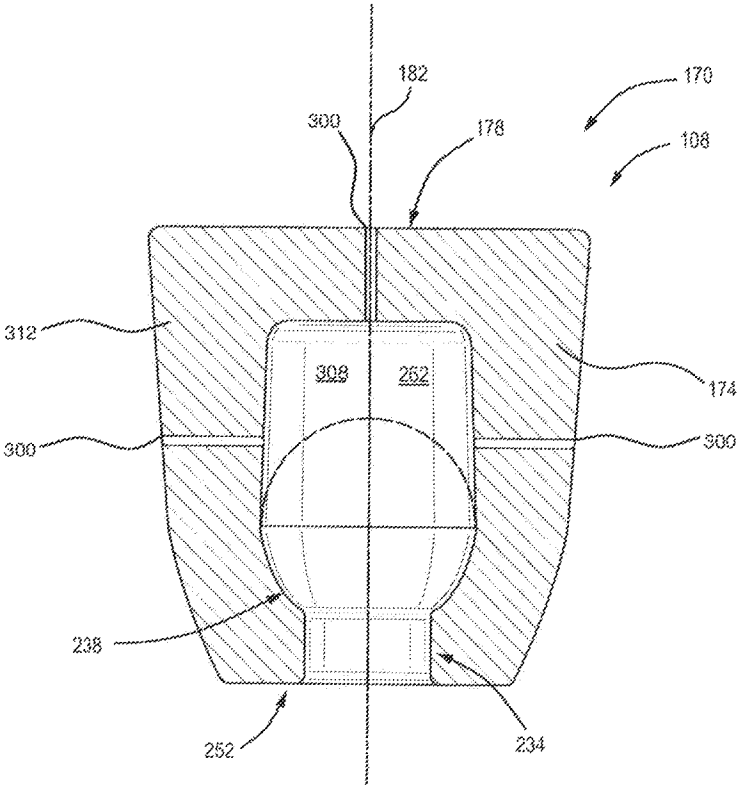
FIG. 28 is a side elevation section view of an illustration of a bumper portion with an air volume therein and without vibration dampers in accordance with at least one embodiment of the present invention.

FIG. 28 depicts a string bumper 170 embodied without vibration dampers 186. The bumper portion 108 has a complete string-contacting surface 178. The sting bumper 170 remains with the air volume 262 therein acting as previously described. The external shape of the string bumper 170 can vary without departing form the scope of the invention. The volume and the shape of the air volume 262 can also vary without departing form the scope of the invention.

An additional embodiment is illustrated in FIGS. 8, 9, 10, 14, 15, 16, 17, 18, 19, 20, 23, 25, 26, 27 and 28. The string bumper 170 can optionally include an opening 300 between the air volume 262 trapped in the string bumper 170 cavity 308 and the environment. The opening 300 is optional and is generally desirable to allow a pressure relief of the air volume 262 trapped in the cavity 308 in the string bumper 170. The pressure relief can be adjusted by the number of openings 300 and their size. The opening 300 can be useful to install the string bumper 170 on the string bumper receiver 270 eliminating pressure buildup in the string bumper 170. The opening 300 can also be used to adjust the dampening of the string bumper 170 when the string 32 hits the string bumper 170 when propelling an arrow. The opening 300 can be embodied as a puncture opening in the string bumper 170 material. Alternatively, the opening 300 can be embodied as a hole, a slot, a slit 304, or the like without departing from the scope of the invention. In an embodiment, the opening 300 is small enough to limit the air exchange rate between the air volume 262 in the string bumper 170 cavity and the environment. The limited air exchange rate in an embodiment thereof would result in no air exchange through the string bumper 170 wall when the string 32 rapidly hits the string bumper 170. Air exchange occurs through a period of time as a slow leak to balance the pressure between the environment and the air volume 262 cavity 308. In an alternate embodiment, the air exchange rate can be faster to allow a more rapid pressure adjustment of the air volume 262.

The string bumper 170 can include a single opening 300 or a plurality of openings 300 without departing from the scope of the present invention. The opening 300 can be located on the string contact surface 178 and/or the side wall 312 of the body 174. Different numbers of openings 300 at various locations on the string bumper 170 are contemplated by the present application.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A bumper for limiting a string displacement on a projectile accelerating apparatus and absorbing vibrations thereof, the projectile accelerating device comprising:
- a pair of limbs operatively connected with the string to propel a projectile,
  - the bumper comprising:
  - a hollowed body including
  - an opening portion at a first end of the body, the opening portion including a first diameter opening inside the body;
  - an expansion portion inside the hollowed body and adjacent to the opening portion, the expansion portion widening the first diameter opening inside the hollowed body;
  - a damper portion adjacent to the expansion portion inside the hollowed body, the damper portion extending to a distal wall thereof, the damper portion including a compressible cavity containing volume of gas therein;
  - an opening between the cavity and the environment for allowing communication between the cavity and the environment; and
  - a string-contacting portion disposed on an exterior surface of a second end of the body, adjacent to the distal wall and the damper portion, the damper portion being adapted to compress the volume of gas in the damper portion in consequence of a string contact on the string-contacting portion, when the bumper is secured to the projectile accelerating apparatus in an operative position.

2. The bumper of claim 1, wherein the body includes rubber.

3. The bumper of claim 2, wherein the rubber includes a softness of about between 20 duro and 60 duro.

4. The bumper of claim 1, wherein the opening portion, the expansion portion, the damper portion and the string-contacting portion are disposed along an axis thereof.

5. The bumper of claim 1, wherein the body includes a substantially cylindrical exterior shape.

6. The bumper of claim 1, wherein a wall thickness between the distal wall and the string-contacting portion is between 2 mm and 10 mm.

7. The bumper of claim 1, wherein a peripheral wall thickness of the damper portion is between 2 mm and 10 mm.

8. The bumper of claim 1, further comprising at least one vibration damper connected to the bumper.

9. The bumper of claim 1, wherein the expansion portion includes a semi-spherical shape thereof.

10. A projectile accelerating device comprising
- a body; and
- a bumper secured to the body for limiting a string displacement on the projectile accelerating apparatus and absorbing vibrations thereof, the bumper comprising:
  - a hollowed body including
  - an opening portion at a first end of the body, the opening portion including a first diameter opening inside the body;

an expansion portion inside the hollowed body and adjacent to the opening portion, the expansion portion widening the first diameter opening inside the hollowed body;

a damper portion adjacent to the expansion portion inside the hollowed body, the damper portion extending to a distal wall thereof, the damper portion including a cavity containing a volume of gas that is compressible when the opening portion is blocked;

an opening between the cavity and the environment for allowing communication between the cavity and the environment; and a string-contacting portion disposed on an exterior surface of a second end of the body, adjacent to the distal wall and the damper portion, the damper portion being adapted to compress the volume of gas in the damper portion in consequence of a string contact on the string-contacting portion.

11. The projectile accelerating device of claim 10, wherein the body includes rubber.

12. The projectile accelerating device of claim 11, wherein the rubber includes a softness of about between 20 duro and 60 duro.

13. The projectile accelerating device of claim 10, wherein the opening portion, the expansion portion, the damper portion and the string-contacting portion are disposed along an axis thereof.

14. The projectile accelerating device of claim 10, wherein the body includes a substantially cylindrical exterior shape.

15. The projectile accelerating device of claim 10, wherein a wall thickness between the distal wall and the string-contacting portion is between 2 mm and 10 mm.

16. The projectile accelerating device of claim 10, wherein a peripheral wall thickness of the damper portion is between 2 mm and 10 mm.

17. The projectile accelerating device of claim 10, further comprising at least one vibration damper connected to the bumper.

18. The projectile accelerating device of claim 10, wherein the expansion portion includes a semi-spherical shape thereof.

19. A string bumper for a string-equipped projectile accelerating apparatus, the string bumper comprising:

a body including a compressible cavity therein for containing a gas; the body including a string contacting portion for contacting a string of the string-equipped projectile accelerating apparatus when the string-equipped projectile accelerating apparatus is propelling a projectile, the body absorbing vibrations contacting the string, the cavity including an opening smaller than the cavity to communicate with the environment and allow gas exchange with the environment when the cavity is compressed by the string.

20. The string bumper of claim 19, wherein the opening is substantially orthogonally aligned with an interior wall of the compressible cavity.

* * * * *